US011014154B2

(12) United States Patent
Kaneda et al.

(10) Patent No.: US 11,014,154 B2
(45) Date of Patent: May 25, 2021

(54) CASTING DEVICE

(71) Applicant: SINTOKOGIO, LTD., Nagoya (JP)

(72) Inventors: Keishiro Kaneda, Toyokawa (JP); Yukiyoshi Funakoshi, Toyokawa (JP)

(73) Assignee: SINTOKOGIO, LTD., Nagoya (JP)

( * ) Notice: Subject to any disclaimer, the term of this patent is extended or adjusted under 35 U.S.C. 154(b) by 0 days.

(21) Appl. No.: 16/771,448

(22) PCT Filed: Dec. 11, 2018

(86) PCT No.: PCT/JP2018/045548
§ 371 (c)(1),
(2) Date: Jun. 10, 2020

(87) PCT Pub. No.: WO2019/117161
PCT Pub. Date: Jun. 20, 2019

(65) Prior Publication Data

US 2021/0069779 A1 Mar. 11, 2021

(30) Foreign Application Priority Data

Dec. 14, 2017 (JP) ..... JP2017-239652

(51) Int. Cl.
*B22D 23/00* (2006.01)
*B22D 33/02* (2006.01)
(Continued)

(52) U.S. Cl.
CPC ..... *B22D 33/04* (2013.01); *B22C 9/068* (2013.01); *B22D 23/006* (2013.01); *B22D 33/02* (2013.01); *B22D 35/04* (2013.01); *B22D 41/04* (2013.01)

(58) Field of Classification Search
CPC ..... B22D 23/006; B22D 33/02; B22D 33/04; B22D 41/04
See application file for complete search history.

(56) References Cited

U.S. PATENT DOCUMENTS 10,201,851 B2 * 2/2019 Funakoshi ..... B22D 23/006

FOREIGN PATENT DOCUMENTS

JP 2004-268082 A 9/2004
JP 2007-83293 A 4/2007
(Continued)

OTHER PUBLICATIONS

International Preliminary Report on Patentability dated Jun. 25, 2020 for PCT/JP2018/045548.

*Primary Examiner* — Kevin E Yoon
(74) *Attorney, Agent, or Firm* — Faegre Drinker Biddle & Reath LLP

(57) ABSTRACT

A casting apparatus includes an upper frame, a lower frame, an opening/closing mechanism, a first main link member, a first sub-link member, a drive unit, a base frame and a retracting mechanism. The first main link member is provided with a first rotating shaft at a central part thereof. The first sub-link member is disposed in parallel with the first main link member. The first sub-link member is provided with a first bearing at a central part thereof. The drive unit is connected to the first rotating shaft and causes the first main link member to rotate around the first rotating shaft. The base frame includes a second rotating shaft. The second rotating shaft rotatably supports the first sub-link member via the first bearing with the first bearing placed thereon. The retracting mechanism causes the second rotating shaft to retract.

16 Claims, 19 Drawing Sheets

(51) Int. Cl.

| | |
|---|---|
| ***B22D 33/04*** | (2006.01) |
| ***B22D 41/04*** | (2006.01) |
| ***B22D 35/04*** | (2006.01) |
| ***B22C 9/06*** | (2006.01) |

(56) References Cited

FOREIGN PATENT DOCUMENTS

| | | | |
|---|---|---|---|
| JP | 5880792 | B1 | 3/2016 |
| JP | 2019-058941 | A | 4/2019 |

* cited by examiner (a)

(b)

(a)

(b)

(a)

(b)

(a)

(b)

(a)

(b)

CASTING DEVICE

TECHNICAL FIELD

The present disclosure relates to a casting apparatus.

BACKGROUND ART

Patent Literature 1 discloses a gravity type tilting die casting apparatus. This apparatus is provided with an upper frame, a lower frame, an opening/closing mechanism, a first main link member, a first sub-link member and a drive unit. An upper mold is attached to the upper frame. A lower mold is attached to the lower frame. The opening/closing mechanism opens or closes the upper mold and the lower mold by moving either the upper mold or the lower mold up and down. A top end part of the first main link member is rotatably connected to the upper frame, a bottom end part of the first main link member is rotatably connected to the lower frame, and the first main link member is provided with a rotating shaft at a central part thereof. The first sub-link member is disposed in parallel with the first main link member, a top end part of the first sub-link member is rotatably connected to the upper frame, and a bottom end part of the first sub-link member is rotatably connected to the lower frame and is provided with a rotating shaft at a central part thereof. The drive unit is connected to the rotating shaft of the first main link member and rotates the first main link member around the rotating shaft. The upper frame, the lower frame, the first main link member and the first sub-link member constitute a first parallel link mechanism. The upper mold and the lower mold are tilted by rotating the first main link member while the molds are closed.

CITATION LIST

Patent Literature

Patent Literature 1: Japanese Patent No. 5880792

SUMMARY OF INVENTION

Technical Problem

In the casting apparatus described in Patent Literature 1, the rotating shaft of the first sub-link member is placed on a base frame. For this reason, the upper mold and the lower mold can tilt in a direction in which the rotating shaft of the first sub-link member is lifted from the base frame, whereas the upper mold and the lower mold cannot tilt in an opposite direction.

For this reason, in the present technical field, it is preferable that the upper mold and the lower mold be enabled to tilt in both directions.

Solution to Problem

An aspect of the present disclosure is a casting apparatus forming a casting by using openable/closable and tiltable upper and lower molds, with molten metal being poured into the casting apparatus by using gravity. The casting apparatus includes an upper frame, a lower frame, an opening/closing mechanism, a first main link member, a first sub-link member, a drive unit, a base frame and a retracting mechanism. The upper mold is attached to the upper frame. The lower mold is attached to the lower frame. The opening/closing mechanism moves either the upper mold or the lower mold up and down to thereby open or close the upper mold and the lower mold. A top end part of the first main link member is rotatably connected to the upper frame and a bottom end part thereof is rotatably connected to the lower frame. The first main link member includes a first rotating shaft at a central part thereof. The first sub-link member is disposed in parallel with the first main link member, a top end part thereof is rotatably connected to the upper frame and a bottom end part thereof is rotatably connected to the lower frame. The first sub-link member includes a first bearing at a central part thereof. The drive unit is connected to the first rotating shaft, causing the first main link member to rotate around the first rotating shaft. The base frame includes a second rotating shaft. With the first bearing placed on the second rotating shaft, the second rotating shaft rotatably supports the first sub-link member via the first bearing. The retracting mechanism causes the second rotating shaft to retract from a position at which the first bearing can be placed. The upper frame, the lower frame, the first main link member and the first sub-link member constitute a first parallel link mechanism.

In this casting apparatus, the first sub-link member includes the first bearing at the central part thereof. The base frame includes the second rotating shaft. With the first bearing placed on the second rotating shaft, the second rotating shaft rotatably supports the first sub-link member via the first bearing. Since the retracting mechanism causes the second rotating shaft to retract from a position at which the first bearing can be placed thereon, the upper mold and the lower mold can be tilted not only in the direction in which the first bearing is lifted from the second rotating shaft but also in an opposite direction.

The retracting mechanism may also be provided in the base frame. In this case, since the base frame is not rotated by the drive unit, it is possible to reduce a load on the drive unit compared to a case where the retracting mechanism is provided in a part rotated by the drive unit.

The retracting mechanism may move the second rotating shaft in an axial direction thereof. In this case, the retracting mechanism can easily cause the second rotating shaft to retract from a position at which the first bearing can be placed.

The first bearing may also include a groove part capable of abutting on less than or equal to half of an outer circumferential surface of the second rotating shaft in a circumferential direction. In this case, the first bearing is easily placed on the second rotating shaft.

This casting apparatus may further include a second main link member and a second sub-link member. A top end part of the second main link member may be rotatably connected to the upper frame and a bottom end part thereof may be rotatably connected to the lower frame. The second main link member may include a third rotating shaft at a central part thereof. The second sub-link member may be disposed in parallel with the second main link member, a top end part thereof may be rotatably connected to the upper frame, and a bottom end part thereof may be rotatably connected to the lower frame. The second sub-link member may include a second bearing at a central part thereof. The base frame may further include a fourth rotating shaft. With the second bearing placed thereon, the fourth rotating shaft may rotatably support the second sub-link member via the second bearing. The retracting mechanism may cause the fourth rotating shaft to retract from a position at which the second bearing can be placed. The upper frame, the lower frame, the second main link member and the second sub-link member may constitute a second parallel link mechanism. In this case, the second sub-link member includes the second bearing at a central part thereof. The base frame includes the fourth rotating shaft. With the second bearing placed thereon, the fourth rotating shaft rotatably supports the second sub-link member via the second bearing. Since the retracting mechanism causes the fourth rotating shaft to retract from the position at which the second sub-link member can be supported, the upper mold and the lower mold can be tilted not only in the direction in which the second bearing is lifted from the fourth rotating shaft but also in an opposite direction.

Advantageous Effects of Invention

According to the present disclosure, the upper mold and the lower mold can be tilted in both directions.

BRIEF DESCRIPTION OF DRAWINGS

FIG. 3(*b*) is a diagram illustrating the first sub-link member, the rotating shaft and a drive-side support frame.

FIG. 8(*b*) is a diagram illustrating the first sub-link member, the rotating shaft and the drive-side support frame in the second separate state.

FIG. 11(*b*) is a diagram illustrating the first sub-link member, the rotating shaft and the drive-side support frame in a tilted state of right-hand turn.

FIG. 13(*b*) is a diagram illustrating the first sub-link member, the rotating shaft and the drive-side support frame in a tilted state of left-hand turn.

FIG. 16(*b*) is a diagram illustrating the first sub-link member, the rotating shaft and the drive-side support frame in the first separate state.

DESCRIPTION OF EMBODIMENTS

Figure 1:
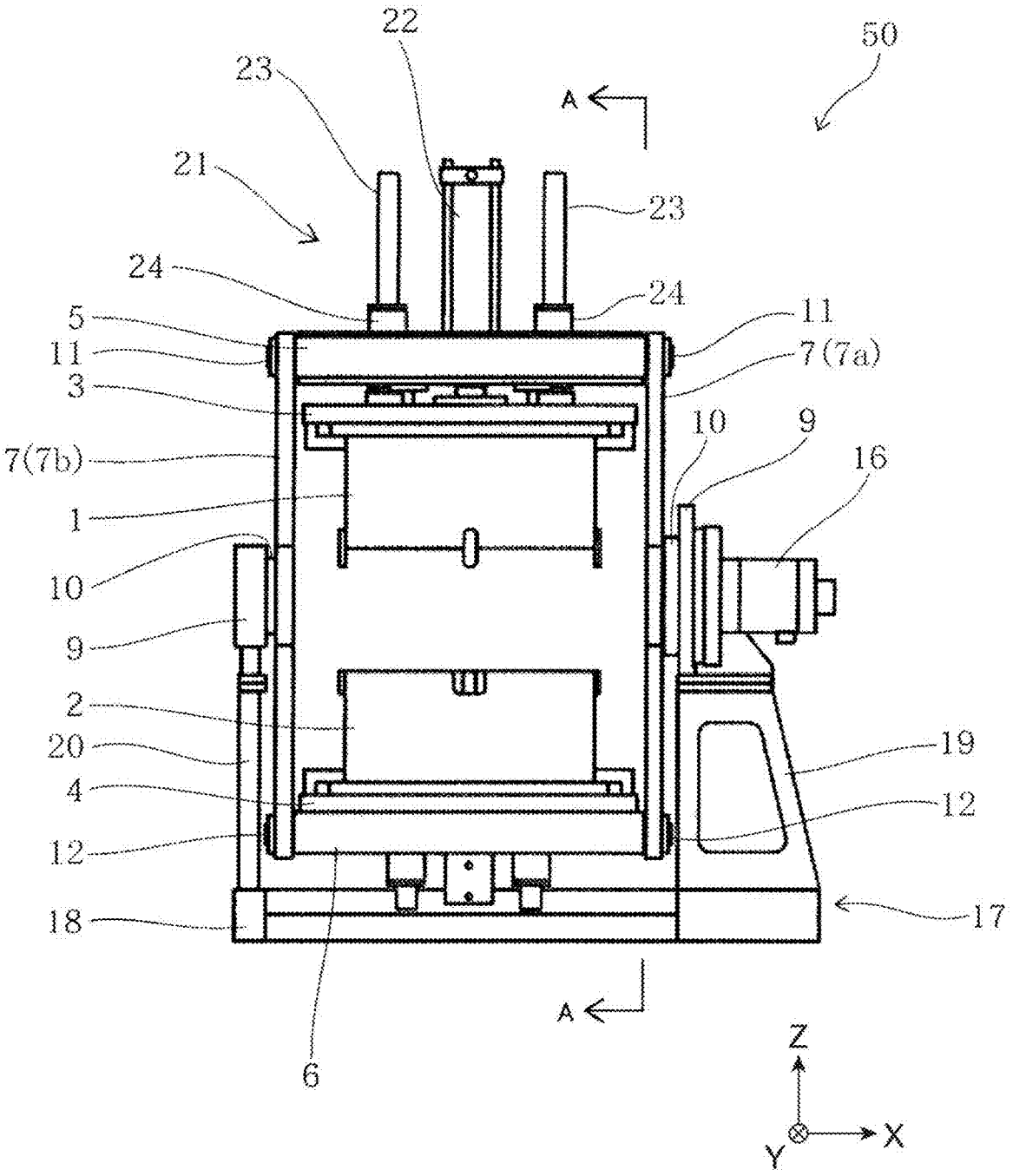
FIG. 1 is a front view of a casting apparatus according to a first embodiment.

Hereinafter, embodiments of the present invention will be described with reference to the accompanying drawings. Note that the same elements in description of the drawings are assigned the same reference numerals and duplicate description thereof will be omitted.

Moreover, dimensional ratios among the drawings do not always correspond to those in the description. Terms like "up," "down," "left" and "right" are based on the illustrated states and used for convenience's sake.

First Embodiment

Figure 2:
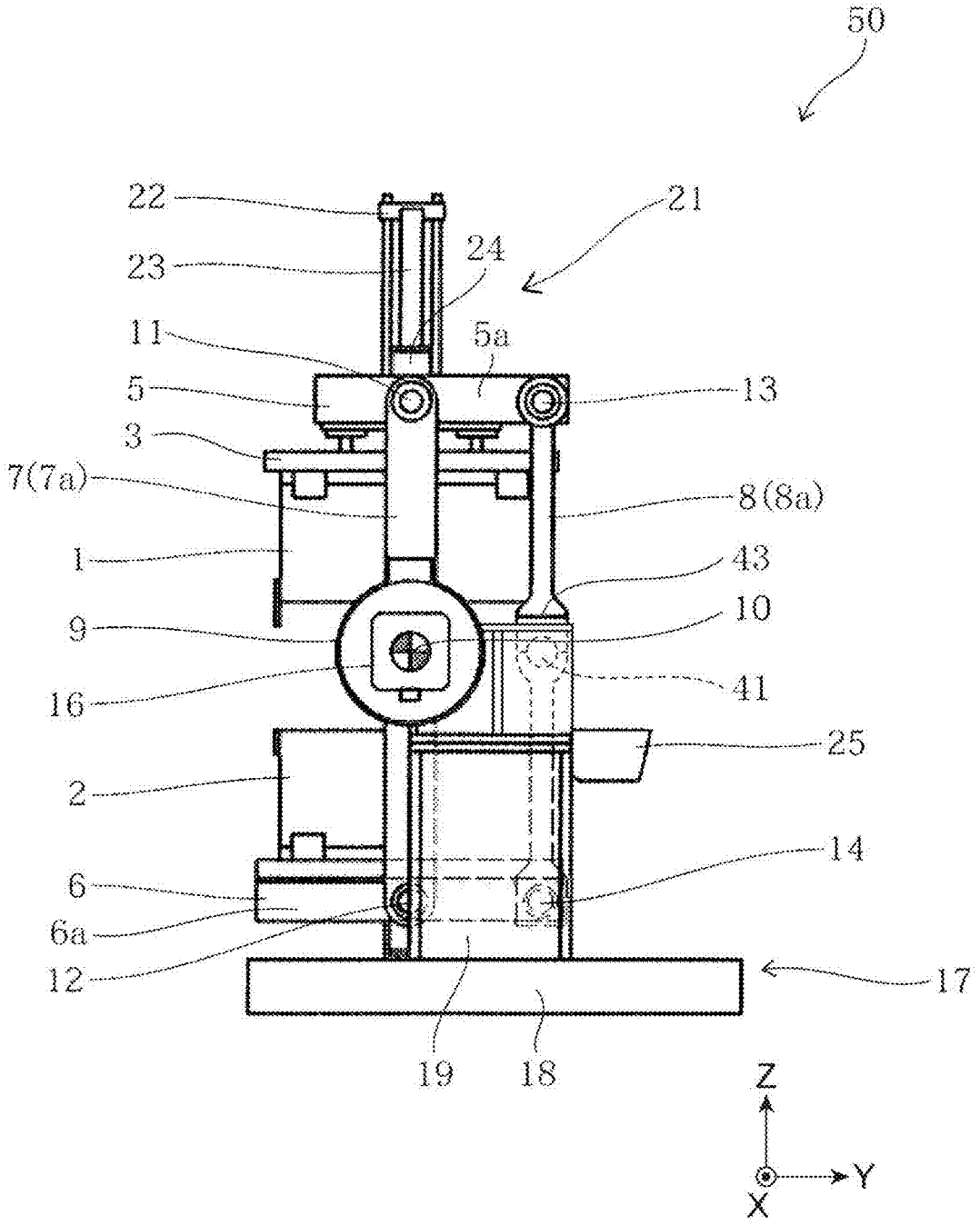
FIG. 2 is a side view of the casting apparatus in FIG. 1.

A configuration of a casting apparatus 50 will be described with reference to FIG. 1 and FIG. 2. FIG. 1 is a front view of a casting apparatus according to a first embodiment. FIG. 2 is a side view of the casting apparatus in FIG. 1. An X direction and a Y direction in the drawings are horizontal directions and a Z direction is a vertical direction. Hereinafter, the X direction will also be referred to as a left-right direction and the Z direction will also be referred to as an up-down direction.

The casting apparatus 50 is a so-called gravity type tilting die casting apparatus into which molten metal is poured using gravity and which forms a casting using an upper mold 1 and a lower mold 2 which can be opened, closed and tilted. The molten metal to be poured can be any material. Examples of the molten metal to be used include aluminum alloy and magnesium alloy. The casting apparatus 50 includes a controller and is configured to be able to control operations of respective components.

As shown in FIG. 1 and FIG. 2, the casting apparatus 50 is provided with, for example, a base frame 17, an upper frame 5, a lower frame 6, an opening/closing mechanism 21, a pair of left and right main link members 7 (first main link member 7*a*, second main link member 7*b*), a pair of left and right sub-link members 8 (first sub-link member 8*a*, second sub-link member 8*b*), a rotation actuator 16 (drive unit), a retracting mechanism 40 and a ladle 25.

The base frame 17 includes a base 18, a drive-side support frame 19, a driven-side support frame 20 and a pair of rotating shafts 41 (a second rotating shaft and a fourth rotating shaft). The base 18 is a substantially flat plate member composed by combining a plurality of members and is provided horizontally on an installation surface of the casting apparatus 50. The drive-side support frame 19 and the driven-side support frame 20 are erected (disposed) on the base 18 in such a way as to face each other in the left-right direction (horizontal direction) across the upper mold 1 and the lower mold 2, the pair of main link members 7 and the pair of sub-link members 8. The pair of main link members 7 and the pair of sub-link members 8 are disposed outside the upper mold 1 and the lower mold 2. The drive-side support frame 19 and the driven-side support frame 20 are disposed outside the pair of main link members 7 and the pair of sub-link members 8. The drive-side support frame 19 and the driven-side support frame 20 are fixed to the base 18.

A pair of tilting rotation bearings 9 are provided at a top end part of the drive-side support frame 19 and at a top end part of the driven-side support frame 20. A pair of tilt rotating shafts 10, which will be described later, are connected to the pair of tilting rotation bearings 9. The pair of rotating shafts 41 are provided on the drive-side support frame 19 and the driven-side support frame 20 at the same height position as that of the pair of tilt rotating shafts 10. The pair of rotating shafts 41 are normally disposed closer to the sides of the pair of sub-link members 8 than the drive-side support frame 19 and the driven-side support frame 20 and at a placement position at which a bearing 42 can be placed. The bearing 42 will be described later. The pair of rotating shafts 41 are coaxial to each other. The pair of rotating shafts 41 have an axial direction in parallel with the axial direction of the pair of tilt rotating shafts 10. The axial direction of the pair of tilt rotating shafts 10 and the pair of rotating shafts 41 are a left-right direction (horizontal direction, X direction here). The pair of rotating shafts 41 are cylindrical members, for example.

The upper frame 5 is disposed above the base frame 17. The upper mold 1 is attached to the upper frame 5. More specifically, the upper mold 1 is mounted on an undersurface of the upper frame 5 via an upper mold die base 3. The upper frame 5 is provided with the opening/closing mechanism 21 moving the upper mold 1 up and down. More specifically, the upper frame 5 incorporates the opening/closing mechanism 21 and holds the upper mold 1 in such a way as to be movable up and down through the opening/closing mechanism 21.

The opening/closing mechanism 21 includes a first hydraulic actuator 22, a pair of left and right guide rods 23 and a pair of left and right guide cylinders 24. The first hydraulic actuator 22 moves either the upper mold 1 or the lower mold 2 up and down to thereby open or close the upper mold 1 and the lower mold 2. In the present embodiment, the first hydraulic actuator 22 moves the upper mold 1 up. A bottom end part of the first hydraulic actuator 22 is mounted on a top surface of the upper mold die base 3. The upper mold die base 3 moves up and down together with the upper mold. The first hydraulic actuator 22 extends in an up-down direction (vertical direction; Z direction here) to thereby move the upper mold 1 down via the upper mold die base 3, and is contracted in the up-down direction to thereby move the upper mold 1 up via the upper mold die base 3. An example of the first hydraulic actuator 22 is a hydraulic cylinder. The guide rods 23 are mounted on the top surface of the upper mold die base 3 through the guide cylinder 24 mounted on the upper frame 5.

The lower frame 6 is disposed above the base frame 17 and below the upper frame 5. The lower mold 2 is attached to the lower frame 6. More specifically, the lower mold 2 is mounted on a top surface of the lower frame 6 via a lower mold die base 4. In the state shown in FIG. 1 and FIG. 2, the upper frame 5 and the lower frame 6 face each other in the up-down direction. Similarly, the upper mold 1 and the lower mold 2 face each other in the up-down direction. The opening/closing mechanism 21 moves the upper mold 1 up and down to thereby close or open the upper mold 1 and the lower mold 2.

Figure 3:
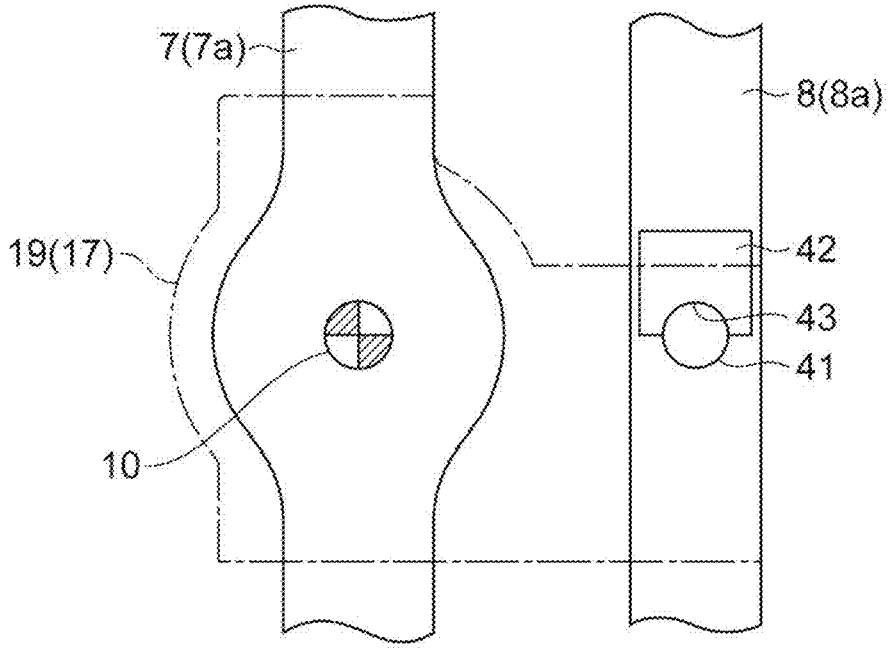
FIG. 3(*a*) is a diagram illustrating a first main link member, a first sub-link member and a rotating shaft.
Figure 3:
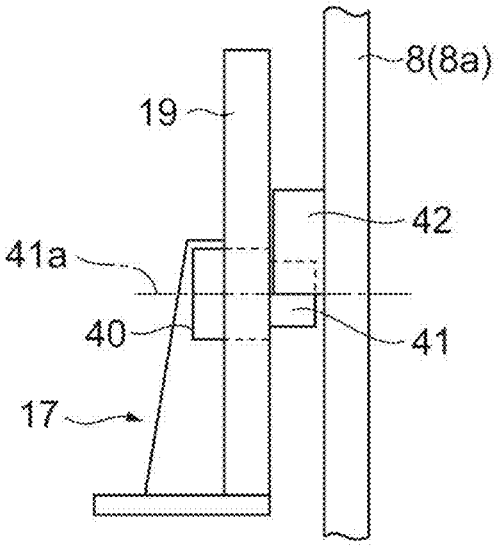

FIG. 3(*a*) is a diagram illustrating the first main link member, the first sub-link member and the rotating shaft. FIG. 3(*a*) is a diagram viewing these members from the drive-side support frame 19 side and the drive-side support frame 19 is shown by a dashed line. FIG. 3(*b*) is a diagram illustrating the first sub-link member, the rotating shaft and the drive-side support frame. FIG. 3(*b*) is a diagram viewing these members from the right side of FIG. 2. As shown in FIG. 1 to FIG. 3, the first main link member 7*a* is a long member. The first main link member 7*a* is, for example, a bar-like member having a rectangular cross section. A top end part of the first main link member 7*a* is rotatably connected to the upper frame 5. A bottom end part of the first main link member 7*a* is rotatably connected to the lower frame 6. The first main link member 7*a* is provided with the tilt rotating shafts 10 (a first rotating shaft and a third rotating shaft) at a central part thereof. The first main link member 7*a* includes a main link upper rotating shaft 11 at the top end part thereof and a main link lower rotating shaft 12 at a bottom end part thereof. The second main link member 7*b* has the same configuration as that of the first main link member 7*a*. The pair of main link members 7 are arranged in such a way as to face each other in the left-right direction (horizontal direction; X direction here). The pair of main link members 7 connect the upper frame 5 and the lower frame 6 respectively. Here, the pair of main link members 7 are arranged in parallel in such a way as to face each other across the upper mold 1 and the lower mold 2.

The central parts of the pair of main link members 7 are rotatably connected to the pair of tilting rotation bearings 9 via the pair of tilt rotating shafts 10. The top end parts of the pair of main link members 7 are rotatably connected to a pair of side faces 5*a* of the upper frame 5 via the pair of main link upper rotating shafts 11. The bottom end parts of the pair of main link members 7 are rotatably connected to a pair of side faces 6*a* of the lower frame 6 via the pair of main link lower rotating shafts 12. When the upper mold 1 and the lower mold 2 are closed, the mounting positions of the pair of main link members 7 with respect to the upper frame 5 and the lower frame 6 are set so that the pair of main link members 7 are located at the respective centers of the upper mold 1 and the lower mold 2 in a depth direction (Y direction) orthogonal to the left-right direction and the up-down direction.

The first sub-link member 8*a* is a long member. The first sub-link member 8*a* is, for example, a bar-like member having a rectangular cross section. The first sub-link member 8*a* is disposed in parallel with the first main link member 7*a*. A top end part of the first sub-link member 8*a* is rotatably connected to the upper frame 5. A bottom end part of the first sub-link member 8*a* is rotatably connected to the lower frame 6. The first sub-link member 8*a* is provided with a bearing 42 (first bearing) at a central part thereof. The first sub-link member 8*a* includes a sub-link upper rotating shaft 13 at a top end part thereof and a sub-link lower rotating shaft 14 at a bottom end part thereof. The second sub-link member 8*b* (not shown) has the same configuration as that of the first sub-link member 8*a*. The second sub-link member 8*b* is disposed in parallel with the second main link member 7*b*. A top end part of the second sub-link member 8*b* is rotatably connected to the upper frame 5. A bottom end part of the second sub-link member 8*b* is rotatably connected to the lower frame 6. The second sub-link member 8*b* is provided with the bearing 42 (second bearing) at a central part thereof. The pair of sub-link members 8 are arranged in such a way as to face each other in the left-right direction, and connect the upper frame 5 and the lower frame 6. The pair of sub-link members 8 are disposed, on the pair of side faces 5*a* and the pair of side faces 6*a*, in parallel with the pair of main link members 7. The sub-link member 8 has the same length as that of the main link member 7.

The bearing 42 includes a groove part 43 capable of abutting on less than or equal to half of the outer circumferential surface of the rotating shaft 41 in the circumferential direction. The groove part 43 is disposed on the sub-link lower rotating shaft 14 side of the bearing 42. The groove part 43 extends, for example, in the left-right direction (horizontal direction, X direction here) and has a semicircular cross section. The groove part 43 is composed of a curved surface. The bearing 42 is placed on the rotating shaft 41 so that the groove part 43 abuts on the rotating shaft 41. As described above, the rotating shaft 41 is normally disposed at a placement position. When the bearing 42 is placed on the rotating shaft 41, the rotating shaft 41 placed at the placement position rotatably supports the first sub-link member 8*a* via the bearing 42.

The retracting mechanism 40 causes the rotating shaft 41 to retract from the placement position. The retracting position at which the retracting mechanism 40 causes the rotating shaft 41 to retract is a position at which the rotating shaft 41 does not interfere with the bearing 42 when the bearing 42 rotates around the tilt rotating shaft 10. By moving the rotating shaft 41 in the axial direction thereof, the retracting mechanism 40 causes the rotating shaft 41 to retract. The retracting mechanism 40 is provided on the base frame 17. The retracting mechanism 40 includes a pair of hydraulic actuators provided on, for example, the drive-side support frame 19 and the driven-side support frame 20. The pair of hydraulic actuators are constructed of hydraulic cylinders with the rotating shaft 41 provided at a leading end thereof. The retracting mechanism 40 places the rotating shaft 41 at the placement position through an extension operation of the hydraulic actuator in the left-right direction (horizontal direction, X direction here) and causes the rotating shaft 41 to retract to a retracting position through a contraction operation of the hydraulic actuator in the left-right direction (horizontal direction, X direction here).

The top end parts of the pair of sub-link members 8 are rotatably connected to the pair of side faces 5*a* of the upper frame 5 via the pair of sub-link upper rotating shafts 13. The bottom end parts of the sub-link members 8 are rotatably connected to the pair of side faces 6*a* of the lower frame 6 via a pair of sub-link lower rotating shafts 14. The mounting position of the sub-link member 8 is on a side where the ladle 25 is disposed with respect to the main link member 7.

In this way, the upper frame 5, the lower frame 6, the first main link member 7*a* and the first sub-link member 8*a* constitute a parallel link mechanism (first parallel link mechanism). Similarly, the upper frame 5, the lower frame 6, the second main link member 7*b* and the second sub-link member 8*b* constitute a parallel link mechanism (second parallel link mechanism). The two parallel link mechanisms are arranged in parallel in such a way as to face each other across the upper mold 1 and the lower mold 2.

The pair of tilt rotating shafts 10 are held (supported) to the base frame 17 via the pair of tilting rotation bearings 9 provided outside the first parallel link mechanism and the second parallel link mechanism. The center of rotation of the tilt rotating shaft 10 of the first main link member 7*a* coincides with the center of gravity of a rotation body including the closed or opened upper mold 1 and lower mold 2, and the upper frame 5 and the lower frame 6. The center of rotation of the tilt rotating shaft 10 of the second main link member 7*b* coincides with the center of gravity of the rotation body including the closed or opened upper mold 1 and lower mold 2, and the upper frame 5 and the lower frame 6. Here, "coincide" is not limited to a case where both coincide completely, but includes a case where errors are contained due to a difference between the weight of the upper mold 1 and the weight of the lower mold 2.

The rotation actuator 16 is disposed on the drive-side support frame 19. The rotation actuator 16 is connected to one of the tilt rotating shafts 10 of the pair of main link members 7 and causes one of the pair of main link members 7 to rotate around the tilt rotating shaft 10. In the present embodiment, the rotation actuator 16 is connected to the tilt rotating shaft 10 of the first main link member 7*a* and causes the first main link member 7*a* to rotate around the tilt rotating shaft 10. The rotation actuator 16 may be operated by any one of electric motor, hydraulic pressure and pneumatic pressure. An example of the rotation actuator 16 is a servo motor. The servo motor is connected to a power supply and operates when supplied with power. The rotation actuator 16 functions as a drive unit separating the upper mold 1 from the lower mold 2 in the tilting or horizontal direction.

The upper mold 1 and the lower mold 2 are tilted when the rotation actuator 16 rotates the tilt rotating shaft 10 of the first main link member 7*a* by 45° to 130° with the upper mold 1 and the lower mold 2 closed by the opening/closing mechanism 21. The upper mold 1 is separated from the lower mold 2 in the horizontal direction when the rotation actuator 16 causes the tilt rotating shaft 10 of the first main link member 7*a* to rotate by a predetermined angle with the upper mold 1 and the lower mold 2 closed by the opening/closing mechanism 21. Separation of the upper mold 1 from the lower mold 2 in the horizontal direction is realized by the rotation actuator 16 causing the first parallel link mechanism to act. At this time, the second parallel link mechanism also acts in accordance with the movement of the first parallel link mechanism. Note that the second parallel link mechanism is not essential. The upper frame 5 and the lower frame 6 may be connected by, for example, only the first parallel link mechanism and the second main link member 7*b*. The upper frame 5 and the lower frame 6 may be connected by only the first parallel link mechanism and the second sub-link member 8*b*.

The ladle 25 is mounted at a top end part of the side face of the lower mold 2. A storage part for storing molten metal is formed in the ladle 25. A pouring port 25*a* (see FIG. 6) of the ladle 25 is connected to a receiving port 2*a* of the lower mold 2 (see FIG. 6).

Figure 4:
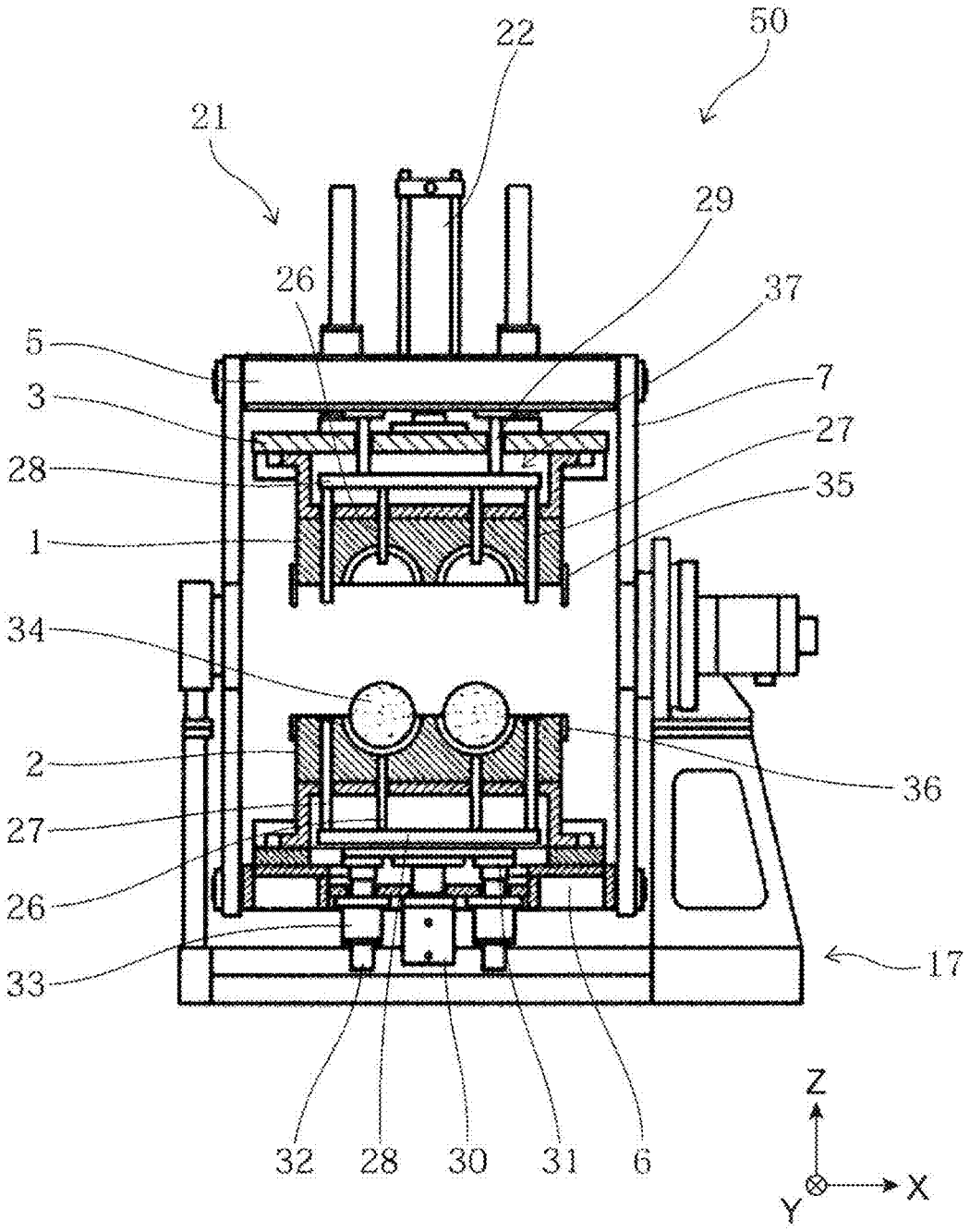
FIG. 4 is a diagram illustrating a cross section of an upper mold and a lower mold in FIG. 1.

FIG. 4 is a diagram illustrating cross sections of the upper mold and the lower mold in FIG. 1. Here, a state is shown in which a plurality of cores 34 are fitted on a top surface of the lower mold 2. As shown in FIG. 4, the casting apparatus 50 is provided with a pushing out mechanism 37 including a pushing out plate 28 (upper pushing out plate), a pair of pushing out pins 26 (upper pushing out pin), a pair of return pins 27 and a plurality of push rods 29 (regulating member). The pushing out mechanism 37 is provided in the upper frame 5.

The pushing out plate 28 is disposed in an inner space formed in the interior on a top end side of the upper mold 1. The pushing out plate 28 is fitted in the inner space in such a way as to be freely movable up and down. Each pushing out pin 26 is provided on an undersurface of the pushing out plate 28. Each pushing out pin 26 moves up and down through a hole from the inner surface of the upper mold 1 to a cavity (upper cavity) in which a casting is formed. Each pushing out pin 26 pushes out the casting in the cavity by a distal end thereof. Each return pin 27 is provided at a position of the pushing out plate 28 different from the pushing out pin 26 of the undersurface. Each return pin 27 moves up and down through the hole from the inner space of the upper mold 1 to an undersurface of the upper mold 1.

Each return pin 27 causes the pushing out plate 28 to move up when the distal end of the return pin 27 abuts against the top surface of the lower mold 2 in a process in which the upper mold 1 and the lower mold 2 are closed.

Each push rod 29 is provided on the undersurface of the upper frame 5. Each push rod 29 is disposed on the undersurface of the upper frame 5 by penetrating the upper mold die base 3. The distal end of each push rod 29 is disposed above the pushing out plate 28 into the inner space with each push rod 29 inserted into the hole from the top surface of the upper mold 1 to the inner space. The length of each push rod 29 is set to a length at which the pushing out plate 28 is pushed down when the first hydraulic actuator 22 is contracted and the upper mold 1 reaches an ascending end. Note that the ascending end is a highest possible position of the upper mold 1 as the first hydraulic actuator 22 is contracted. That is, each push rod 29 passes through the hole from the top surface of the upper mold 1 into the inner space formed at a position above the upper mold 1 entering the inner space by a predetermined length to thereby prevent the pushing out plate 28 from moving up.

The lower frame 6 incorporates a second hydraulic actuator 30. An example of the second hydraulic actuator 30 is a hydraulic cylinder. A top end part of the second hydraulic actuator 30 is mounted on an undersurface of the pushing out member 31. A pair of left and right guide rods 32 pass through guide cylinders 33 attached to the lower frame 6 and are mounted on the undersurface of the pushing out member 31.

As in the case of the upper mold 1, the lower mold 2 incorporates a pushing out plate 28 (lower pushing out plate). A pair of pushing out pins 26 (lower pushing out pins) and a pair of return pins 27 are connected to the pushing out plate 28. There is such a positional relationship in the lower mold 2 that the pushing out member 31 moves up by extending operation of the second hydraulic actuator 30 to push up the pushing out plate 28 and the pair of pushing out pins 26 and the return pins 27 move up. The distal end of each pushing out pin 26 pushes out a casting in a cavity (lower cavity). Note that the return pins 27 of the upper mold 1 and the lower mold 2 are pushed back at the time of mold closing, by a mating surface of the mold opposite to the distal ends of the return pins 27 or the distal ends of the opposite return pins 27. Accordingly, the pushing out pin 26 connected to the pushing out plate 28 is also pushed back. At the time of mold closing, contraction operation of the second hydraulic actuator 30 causes the pushing out member 31 to reach a descending end position. Note that the descending end refers to a lowest possible position of the lower mold 2 as the second hydraulic actuator 30 is contracted.

A pair of positioning keys 35 are mounted in the lower periphery (side face bottom end part) of the upper mold 1. A pair of key grooves 36 are provided in the upper periphery (side face top end part) of the lower mold 2 in such a way as to be engageable with the pair of positioning keys 35. The positioning keys 35 and the key grooves 36 constitute a positioning unit for positioning the upper mold 1 and the lower mold 2 in the horizontal direction. According to this positioning unit, since the upper mold 1 and the lower mold 2 are positioned in the horizontal direction, it is possible to prevent the upper mold 1 and the lower mold 2 from being displaced and closed.

Figure 5:
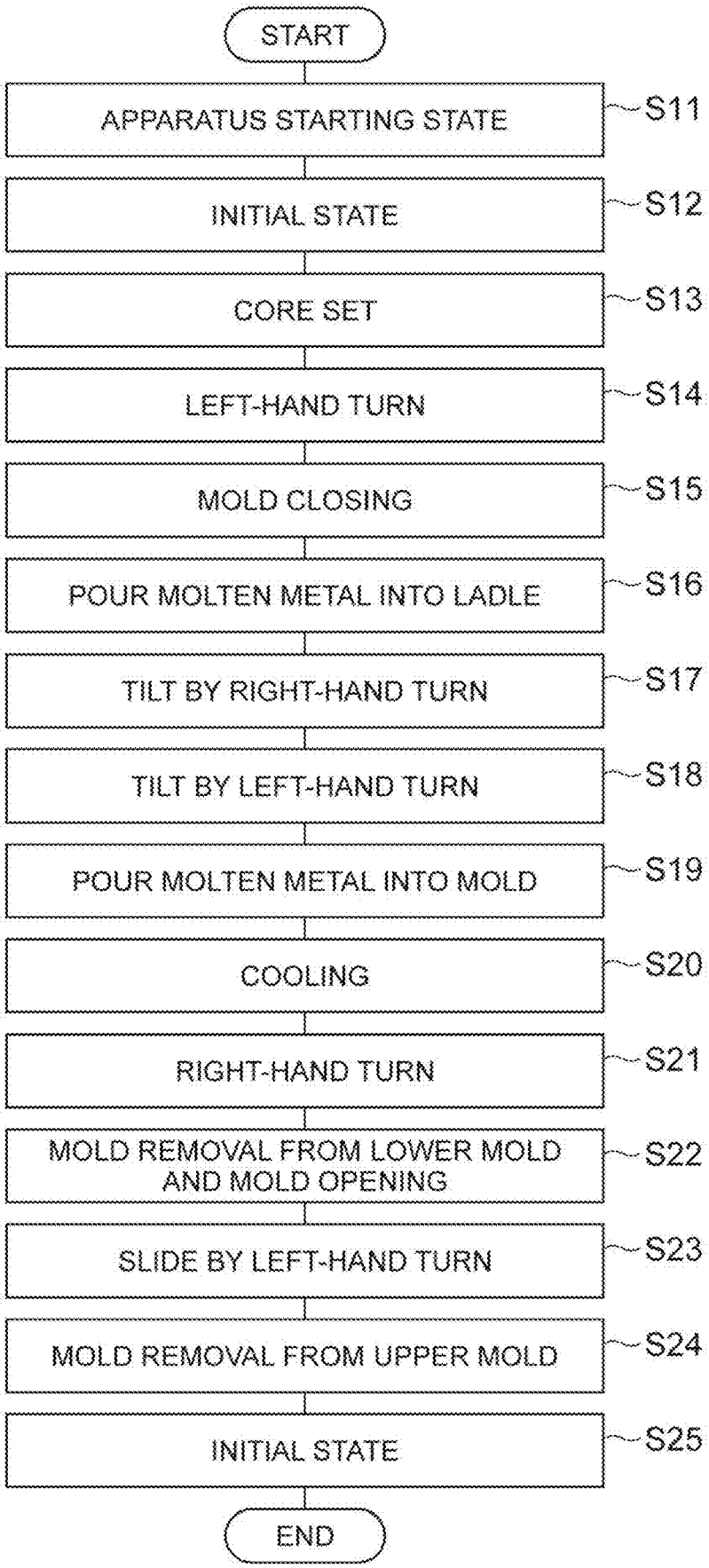
FIG. 5 is a flowchart illustrating a casting method by the casting apparatus in FIG. 1.
Figure 6:
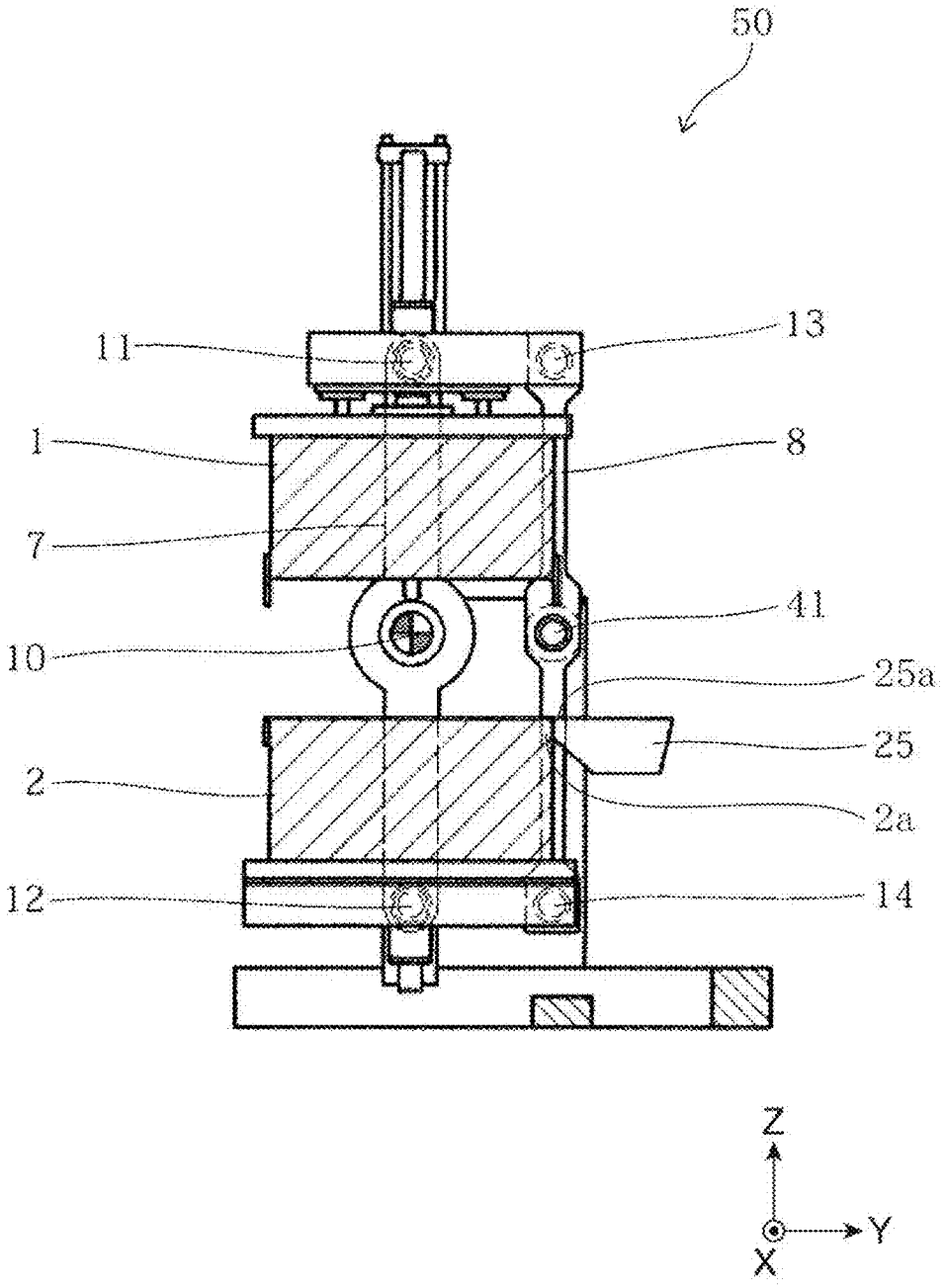
FIG. 6 is a diagram viewed from an arrow direction of a line A-A in FIG. 1 and for describing an apparatus starting state.

Next, an example of a casting method using the casting apparatus 50 will be described with reference to FIG. 5 to FIG. 17. As shown in FIG. 5 and FIG. 6, at the start of power supply, the upper mold 1 of the casting apparatus 50 is at an ascending end and the pair of main link members 7 and the pair of sub-link members 8 are perpendicular to the installation surface of the casting apparatus 50 (apparatus starting state: step S11). The pair of rotating shafts 41 are disposed at placement positions. The center of gravity of the upper mold 1 is set to be positioned closer to the rotating shaft 41 side than the tilt rotating shaft 10. For this reason, the bearing 42 receives a downward force and the groove part 43 is placed on the rotating shaft 41 in such a way as to be pressed against the outer circumferential surface of the rotating shaft 41. This causes the rotating shaft 41 to support the sub-link member 8 via the bearing 42 (see FIG. 3).

Note that the casting apparatus 50 is disposed between a workspace (not shown) and a pouring apparatus (not shown). The casting apparatus 50 is disposed such that the ladle 25 faces the workspace (not shown) in the Y direction. The workspace is a space for the operator to perform a core fitting operation or the like. The pouring apparatus is an apparatus that pours molten metal into the ladle 25. For example, a conveyor (not shown) is disposed between the casting apparatus 50 and the workspace. The conveyor is an apparatus that carries a casting (cast product) cast by the casting apparatus 50. The conveyor extends up to an apparatus in a post-process (e.g., product cooling apparatus, sand shakeout apparatus, product finishing apparatus or the like).

Figure 7:
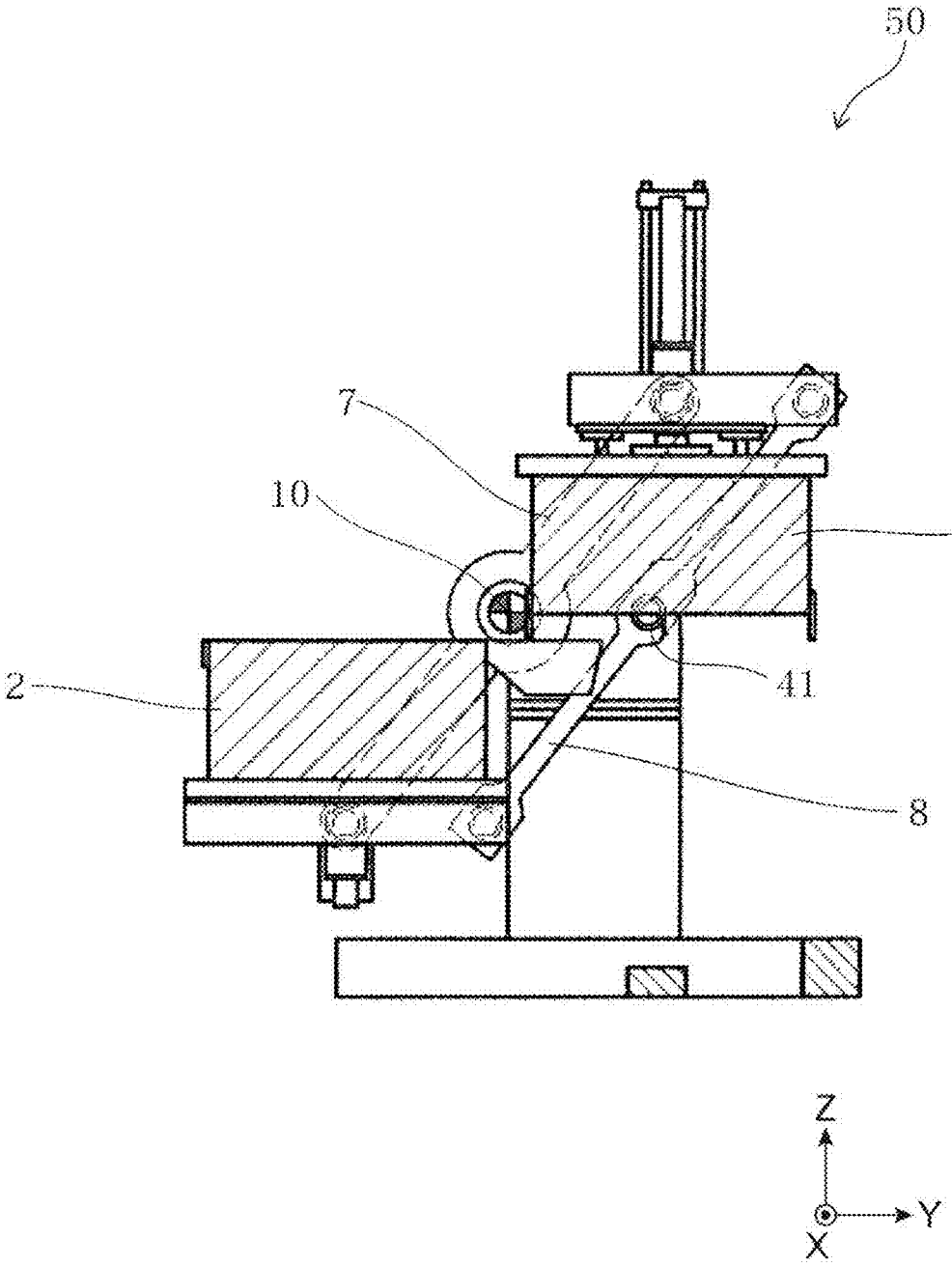
FIG. 7 is a diagram illustrating a second separate state in which upper and lower molds are slid through operation of a parallel link mechanism and describing an initial state of a manufacturing step.
Figure 8:
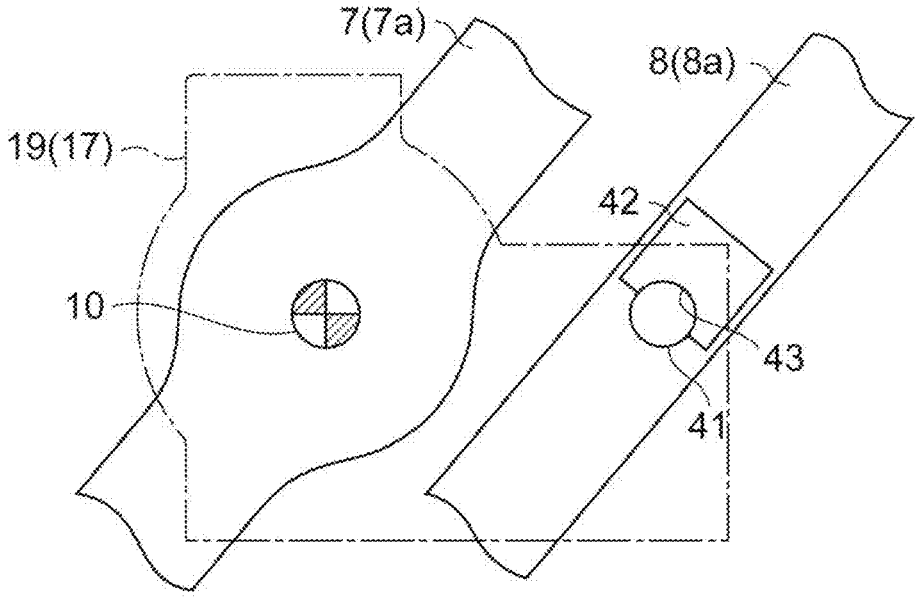
FIG. 8(*a*) is a diagram illustrating the first main link member, the first sub-link member and the rotating shaft in a second separate state.
Figure 8:
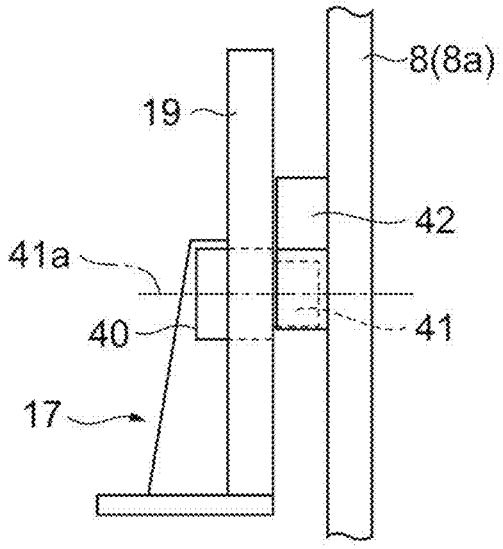

Next, as shown in FIG. 5, FIG. 7 and FIG. 8, the casting apparatus 50 is placed into an initial state of a series of casting processes (step S12). The casting apparatus 50 is changed from a state shown in FIG. 6 to an initial state shown in FIG. 7. In step S12, the rotation actuator 16 drives the tilt rotating shaft 10 of the first main link member 7*a* to rotate clockwise. In the present embodiment, a turn in the clockwise direction is assumed to be a right-hand turn and the opposite turn is assumed to be a left-hand turn. The upper mold 1 and the lower mold 2 slide in an arc in opposite directions through action of the parallel link mechanism. More specifically, when the mutually opposing upper mold 1 and lower mold 2 make circular motion of right-hand turn around the tilt rotating shaft 10 as a center, and the upper mold 1 and the lower mold 2 move away from each other in the horizontal direction. At this time, the upper mold 1 has moved to the pouring apparatus side (second separate state). This second separate state is an initial state of a series of casting steps. In the present embodiment, the state in which the lower mold 2 has moved to the pouring apparatus side is assumed to be a first separate state and the state in which the upper mold 1 has moved to the pouring apparatus side is assumed to be a second separate state. That is, the first separate state (see FIG. 15) is a state in which the rotation actuator 16 causes the upper mold 1 to move in a direction away from the pouring apparatus and the lower mold 2 to move in a direction approaching the pouring apparatus, whereby the upper mold 1 and the lower mold 2 separate from each other in the horizontal direction. The second separate state (see FIG. 7) is a state in which the rotation actuator 16 causes the upper mold 1 to move in the direction approaching the pouring apparatus and the lower mold 2 to move in a direction away from the pouring apparatus, whereby the upper mold 1 and the lower mold 2 remain separate from each other in the horizontal direction.

Next, the core 34 (see FIG. 4) is fitted in a predetermined position of the lower mold 2 (step S13). Fitting of the core 34 is performed by, for example, the operator. The core 34 is molded using, for example, a core molding machine (not shown). In the second separate state, the lower mold 2 is open upward and the ladle 25 mounted on the lower mold 2 is not in contact with the upper mold 1. Since the lower mold 2 is open upward in this way, the core 34 can be fitted in the lower mold 2 safely.

Figure 9:
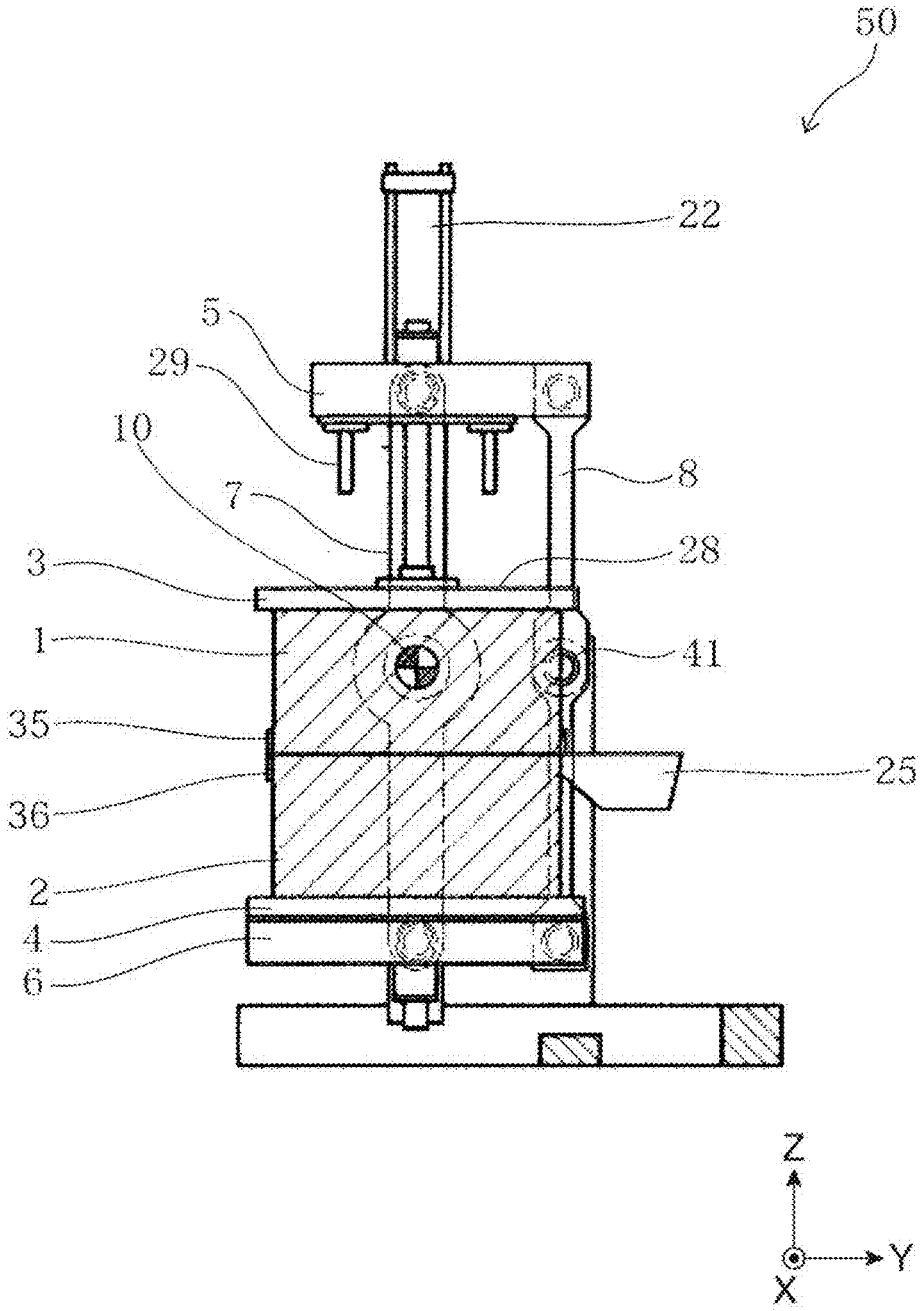
FIG. 9 is a diagram for describing a mold closed state in which the upper mold and the lower mold are closed.

Next, the casting apparatus 50 causes the rotation actuator 16 to drive the tilt rotating shaft 10 of the first main link member 7*a* to turn counterclockwise and then return to the apparatus starting state in FIG. 6 (step S14). Next, as shown in FIG. 5 and FIG. 9, the casting apparatus 50 extends the first hydraulic actuator 22 to close the upper mold 1 and the lower mold 2 (step S15). At this time, the positioning key 35 of the upper mold 1 engages with the key groove 36 of the lower mold 2, and the upper mold 1 and the lower mold 2 are fixed in the horizontal direction. Furthermore, mold closing prevents rotations of the pair of main link members 7 and the pair of sub-link members 8, the main link upper rotating shaft 11, the main link lower rotating shaft 12, the sub-link upper rotating shaft 13 and the sub-link lower rotating shaft 14, which integrates the upper mold 1, the lower mold 2, the upper frame 5, the lower frame 6, the pair of main link members 7 and the pair of sub-link members 8 together.

Figure 10:
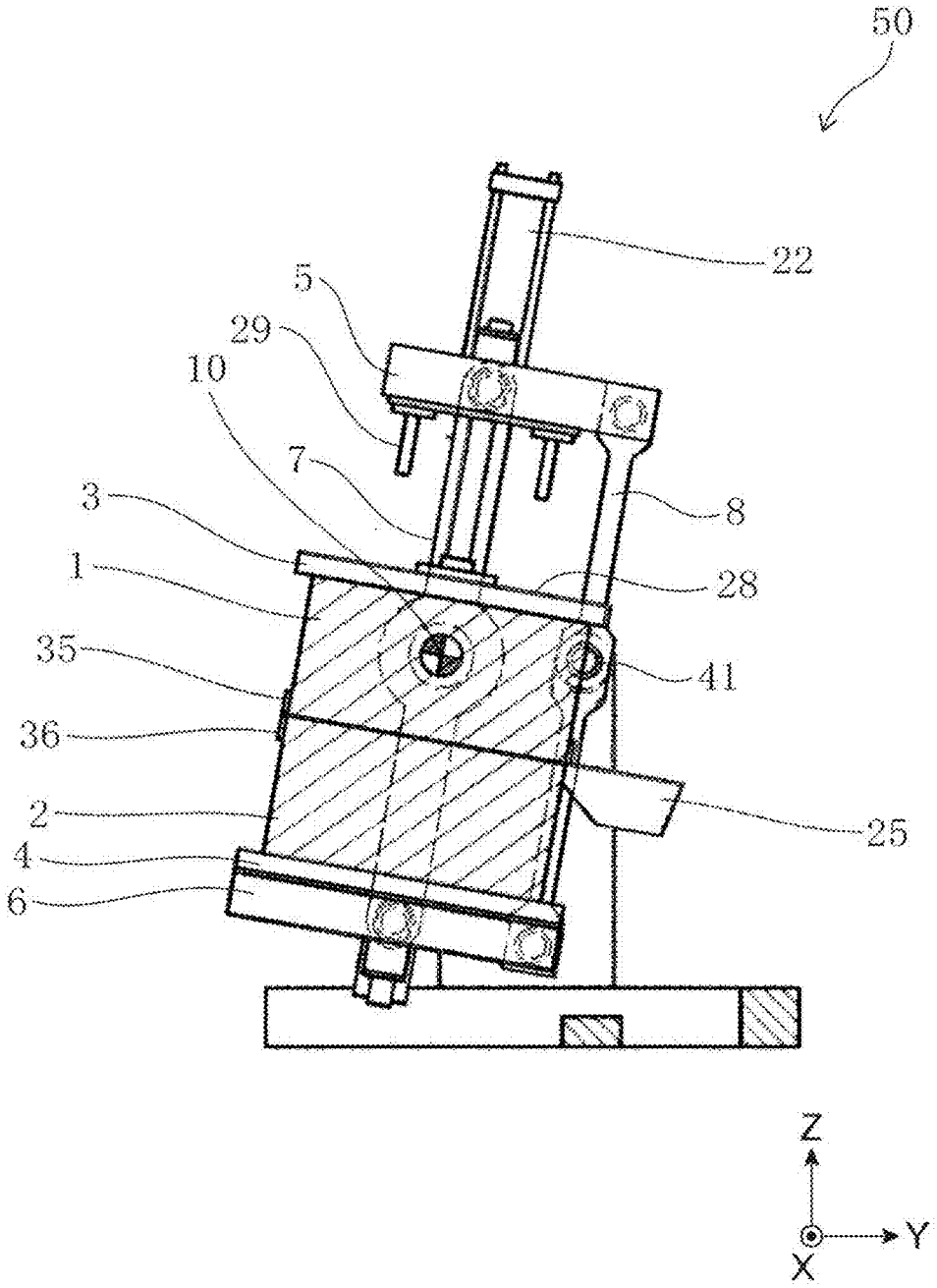
FIG. 10 is a diagram illustrating the closed upper mold and lower mold, tilted by right-hand turn.
Figure 11:
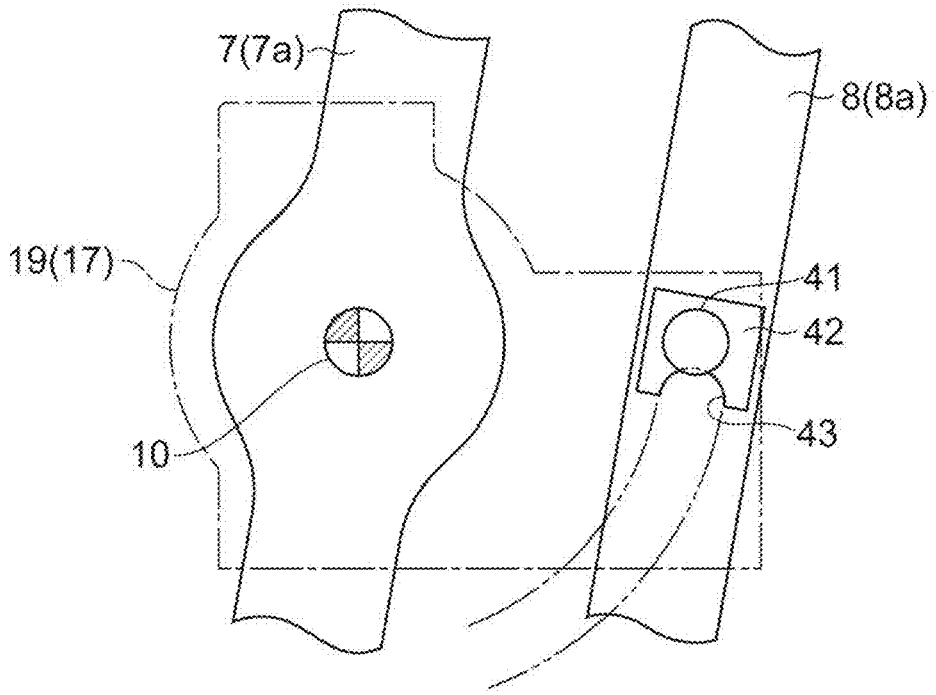
FIG. 11(*a*) is a diagram illustrating the first main link member, the first sub-link member and the rotating shaft in a tilted state of right-hand turn.
Figure 11:
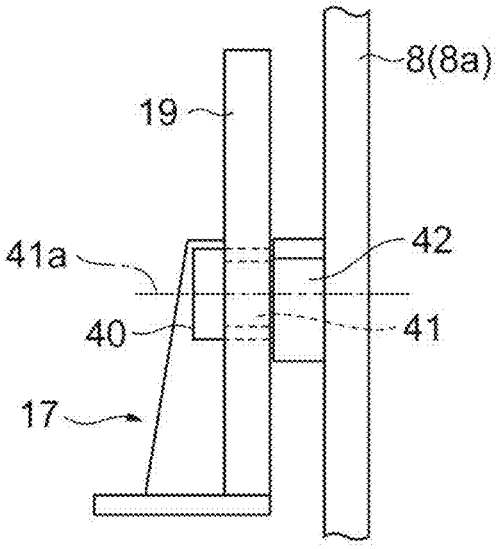

Next, when the upper mold 1 and the lower mold 2 are closed, that is, in a mold-closed state, the pouring apparatus supplies molten metal into the ladle 25 (step S16). Next, as shown in FIG. 5, FIG. 10 and FIG. 11, using the retracting mechanism 40, the casting apparatus 50 causes the rotating shaft 41 to retract from the placement position to the retracting position. Then, the casting apparatus 50 causes the rotation actuator 16 to drive the tilt rotating shaft 10 of the first main link member 7*a* to make a right-hand turn by approximately 10° to bring the upper mold 1 and the lower mold 2 into a tilted state of right-hand turn (step S17). This causes the bearing 42 to make a right-hand turn around the tilt rotating shaft 10 and move downward to a position below the height position at which the rotating shaft 41 is provided. Note that in FIG. 11, a track of the groove part 43 is shown by a two-dot dashed line.

Figure 12:
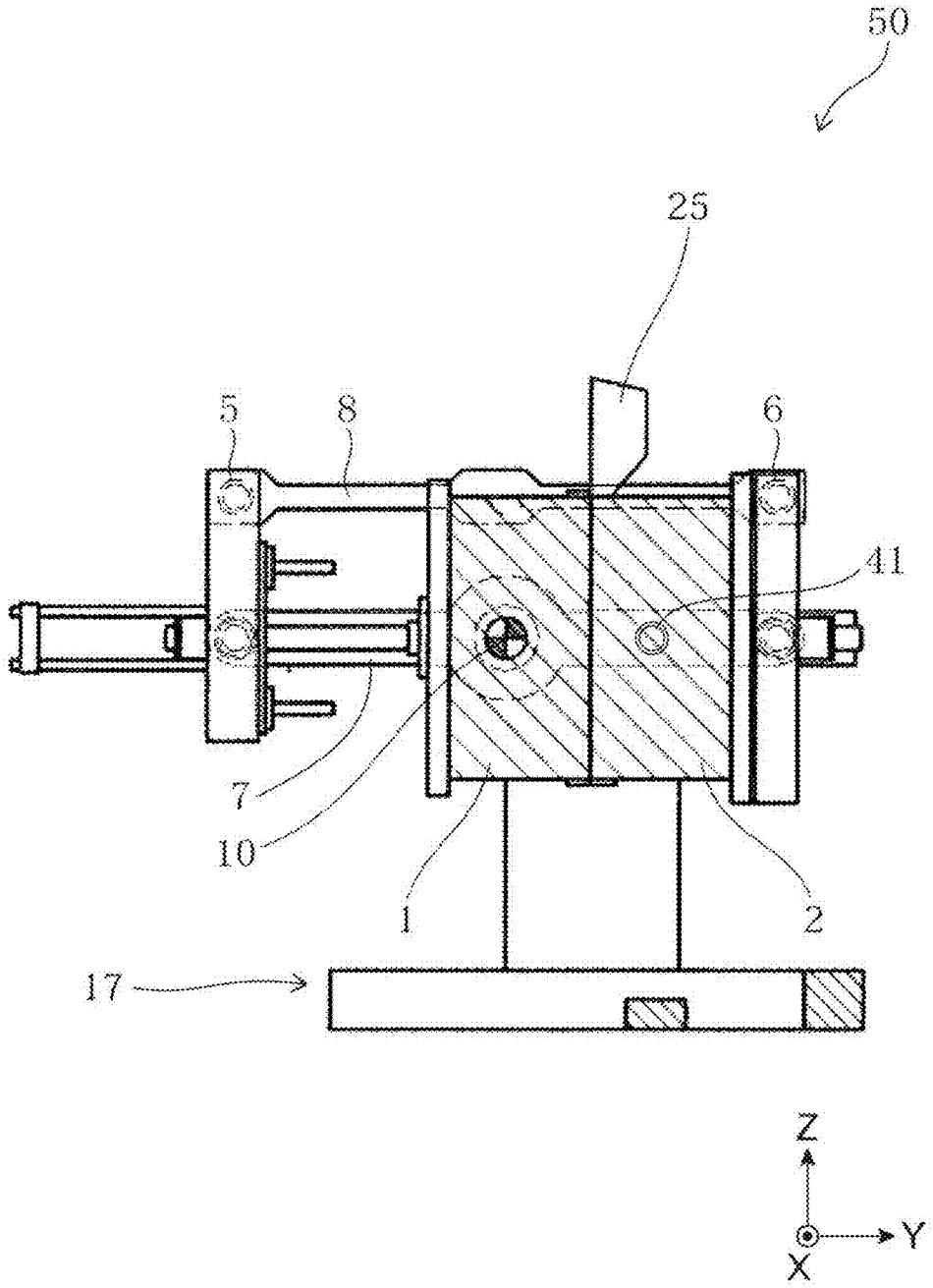
FIG. 12 is a diagram illustrating the closed upper mold and lower mold, tilted by left-hand turn.
Figure 13:
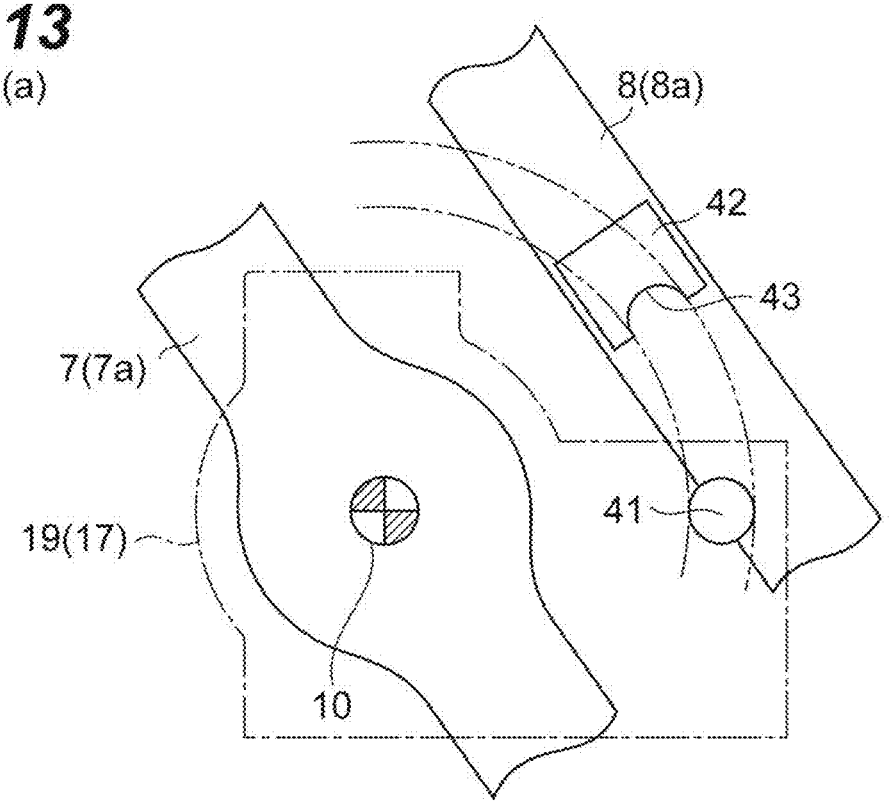
FIG. 13(*a*) is a diagram illustrating the first main link member, the first sub-link member and the rotating shaft in a tilted state of left-hand turn.
Figure 13:
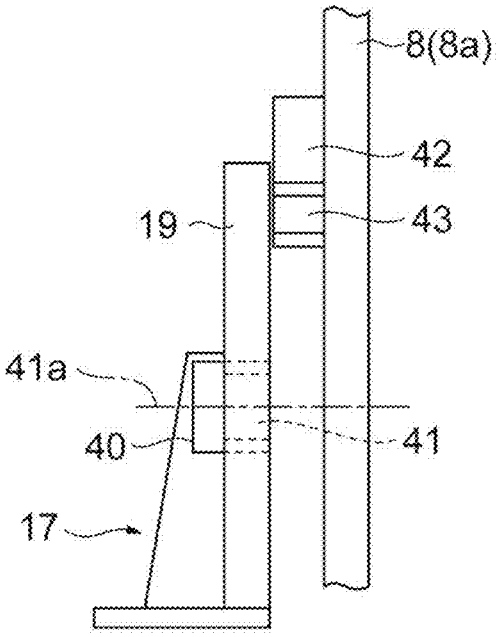

Next, as shown in FIG. 5, FIG. 12 and FIG. 13, the casting apparatus 50 causes the rotation actuator 16 to drive the tilt rotating shaft 10 of the first main link member 7*a* to make a left-hand turn by approximately 100° to bring the upper mold 1 and the lower mold 2 into a tilted state of left-hand turn (step S18). Accordingly, the closed and integrated upper mold 1, lower mold 2, upper frame 5, lower frame 6, pair of main link members 7 and pair of sub-link members 8 rotate and the molten metal in the ladle 25 is tilted and poured into the cavity formed between the upper mold 1 and the lower mold 2 (step S19). The bearing 42 makes a left-hand turn around the tilt rotating shaft 10 and moves above the height position at which the rotating shaft 41 is provided. Note that FIG. 13 shows a track of the groove part 43 by a two-dot dashed line.

After the process in the step S19 ends, the state in FIG. 12 is kept for a predetermined time, waiting for the poured molten metal to coagulate (cool) (step S20). Note that as described above, the rotation actuator 16 is caused to drive the tilt rotating shaft 10 of the first main link member 7*a* to turn counterclockwise by approximately 100°, but the tilt rotating shaft 10 may also be caused to turn by a predetermined angle within a range of 45° to 130° or 45° to 90°.

Figure 14:
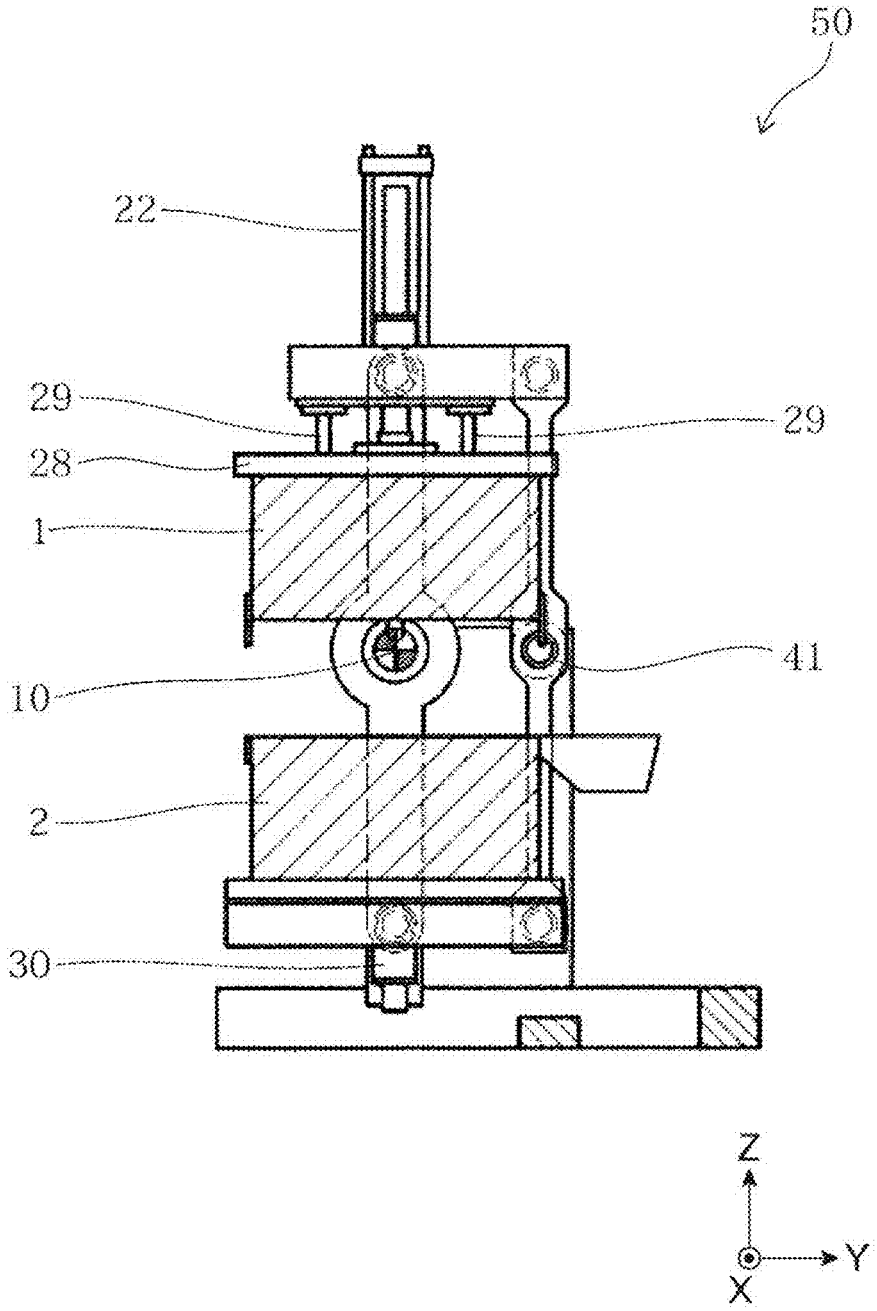
FIG. 14 is a diagram illustrating the upper mold raised up to a midway position.

Next, using the retracting mechanism 40, the casting apparatus 50 disposes the rotating shaft 41 at the placement position. After that, the casting apparatus 50 causes the rotation actuator 16 to drive the tilt rotating shaft 10 of the first main link member 7*a* to make a right-hand turn by approximately 90° and returns to the state in FIG. 9 (step S21). Next, mold removal and mold opening from the lower mold 2 are simultaneously performed (step S22). Mold opening is performed as shown in FIG. 5 and FIG. 14 and mold removal from the lower mold 2 is also performed simultaneously. Mold opening is started by the casting apparatus 50 operating the first hydraulic actuator 22. Extending operation of the second hydraulic actuator 30 starts simultaneously with the contracting operation of the first hydraulic actuator 22. When the second hydraulic actuator 30 extends, the pushing out pin 26 (see FIG. 4) incorporated in the lower mold 2 is pushed out. This causes the casting (not shown) consisting of coagulated molten metal in the upper mold 1 and the lower mold 2 to be removed from the lower mold 2 and remain held to the upper mold 1. The casting apparatus 50 causes the upper mold 1 to move up to a predetermined position and mold opening is completed. The predetermined position is a position where the distal end of the push rod 29 is not in contact with the top surface of the pushing out plate 28 of the upper mold 1. In other words, the predetermined position is a position where there is a gap between the distal end of the push rod 29 and the top surface of the pushing out plate 28 of the upper mold 1.

Figure 15:
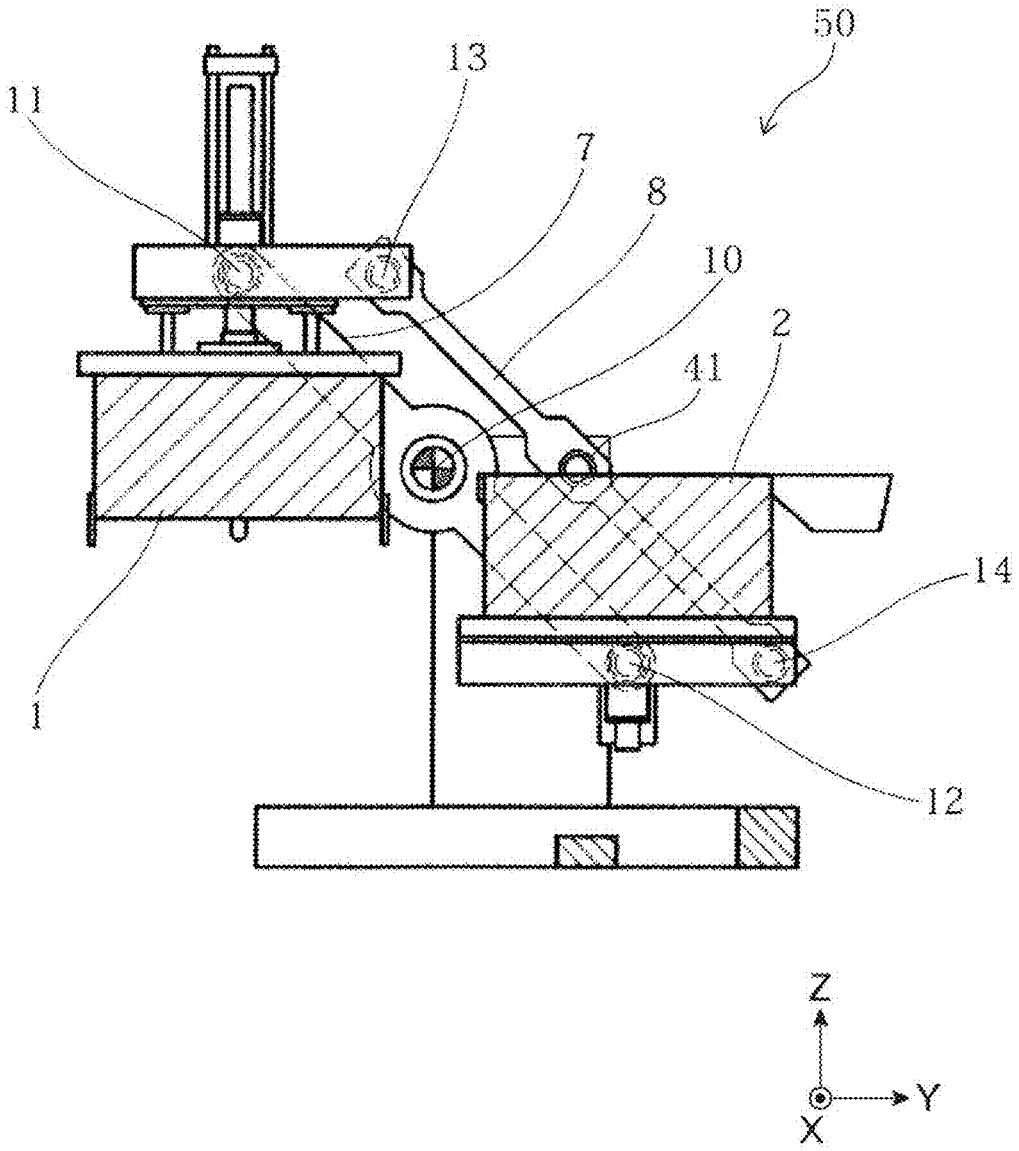
FIG. 15 is a diagram illustrating the upper mold and the lower mold slid into a first separate state.
Figure 16:
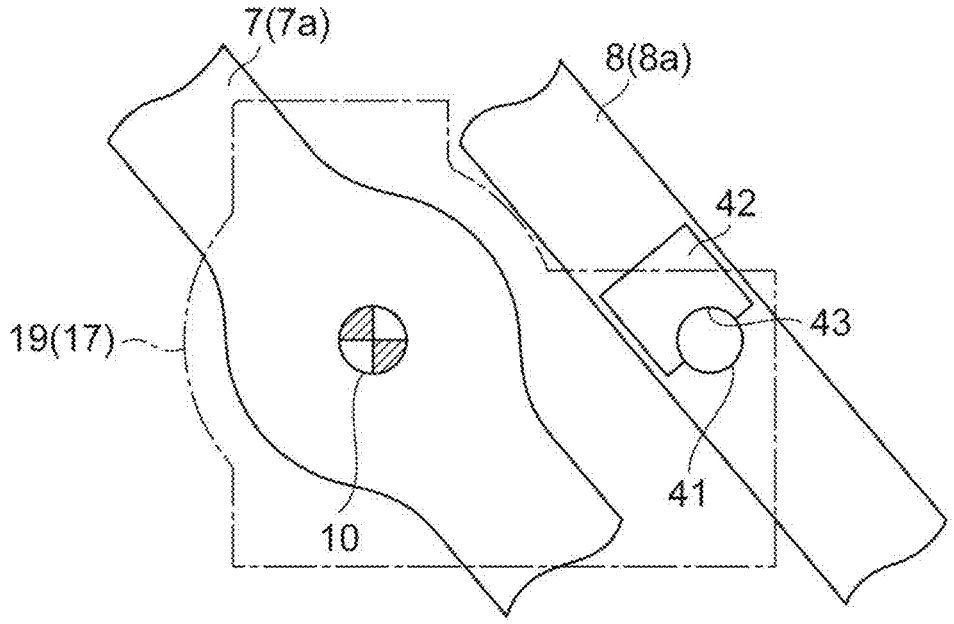
FIG. 16(*a*) is a diagram illustrating the first main link member, the first sub-link member and the rotating shaft in a first separate state.
Figure 16:
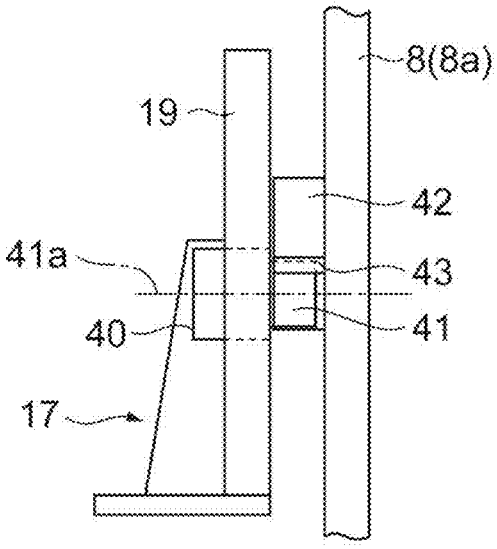

Next, as shown in FIG. 5, FIG. 15 and FIG. 16, the casting apparatus 50 causes the rotation actuator 16 to drive the tilt rotating shaft 10 of the first main link member 7*a* to turn counterclockwise (step S23). Through the action of the parallel link mechanism, the casting apparatus 50 causes the upper mold 1 and the lower mold 2 to slide in an arc and separates them apart in the horizontal direction. At this time, a state in which the upper mold 1 has moved to the conveyor side, that is, a first separate state in which the lower mold 2 has moved in a direction approaching the pouring apparatus. The angle of left-hand turn of the rotation actuator 16 at this time becomes on the order of 30° to 45° at which the upper mold 1 is opened downward.

Figure 17:
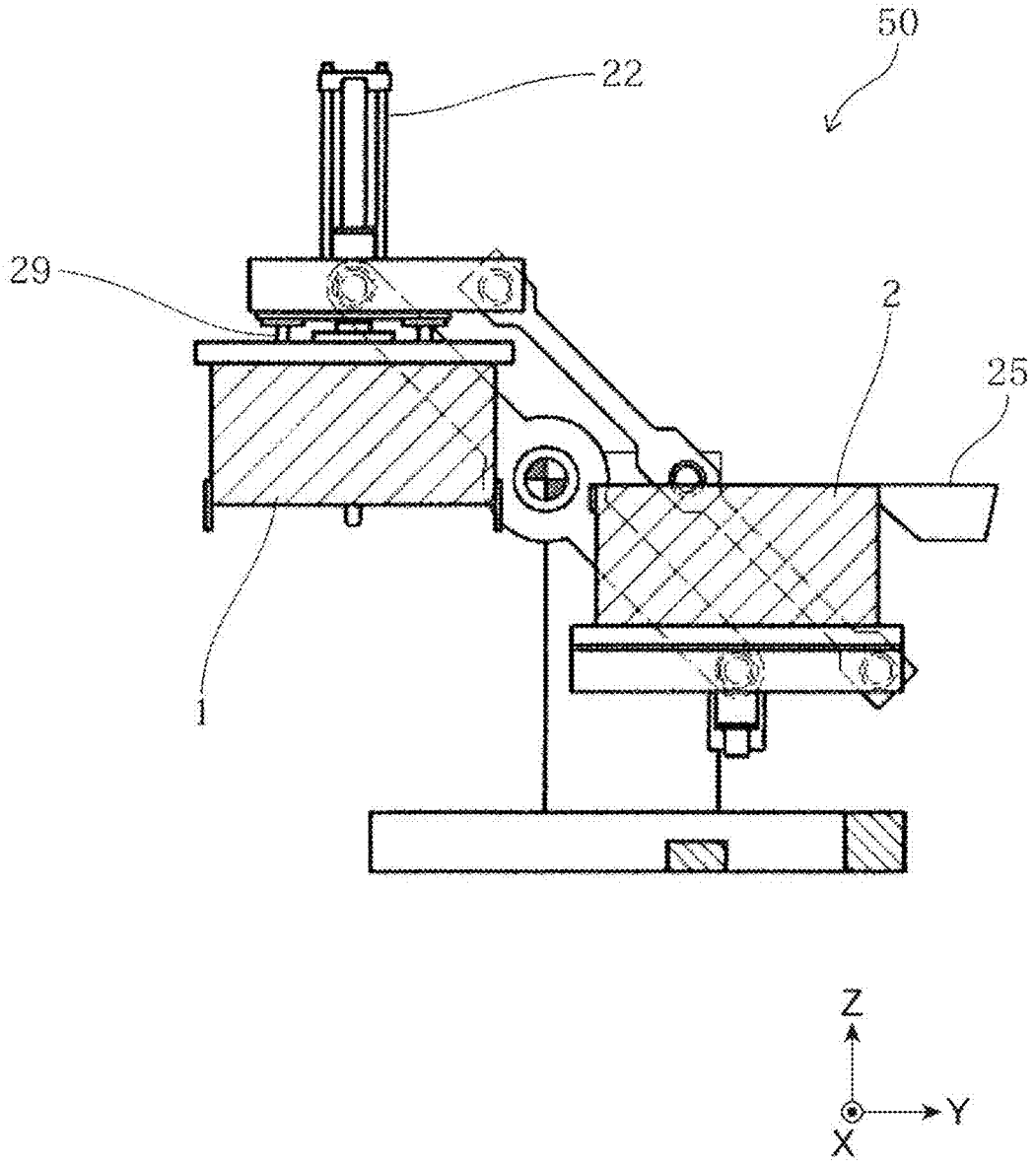
FIG. 17 is a diagram illustrating the upper mold raised from the state in FIG. 15 up to an ascending end.

Next, as shown in FIG. 5 and FIG. 17, the casting apparatus 50 contracts the first hydraulic actuator 22 to move the upper mold 1 up to an ascending end. In this way, the distal end of the push rod 29 relatively pushes out the pushing out pin 26 (see FIG. 4) with respect to the upper mold 1 via the pushing out plate 28 incorporated in the upper mold 1. As a result, the casting held to the upper mold 1 is removed from the upper mold 1 (step S24). The casting removed from the upper mold 1 drops and is received by the conveyor provided below the upper mold 1. That is, the conveyor functions as a receiver receiving the casting as well. After that, the casting is carried by the conveyor to, for example, a product cooling apparatus, a sand shakeout apparatus and a product finishing apparatus carrying out deburring or the like.

Next, as shown in FIG. 5, the casting apparatus 50 causes the rotation actuator 16 to drive the tilt rotating shaft 10 of the first main link member 7*a* to turn clockwise (step S25). In this way, the casting apparatus 50 returns to the initial state (see FIG. 7). As described above, a series of casting processes are completed and a casting is cast by the casting apparatus 50. When the casting processes are consecutively performed, castings can be cast consecutively by repeating processes from the core setting process in step S13.

Second Embodiment

Figure 18:
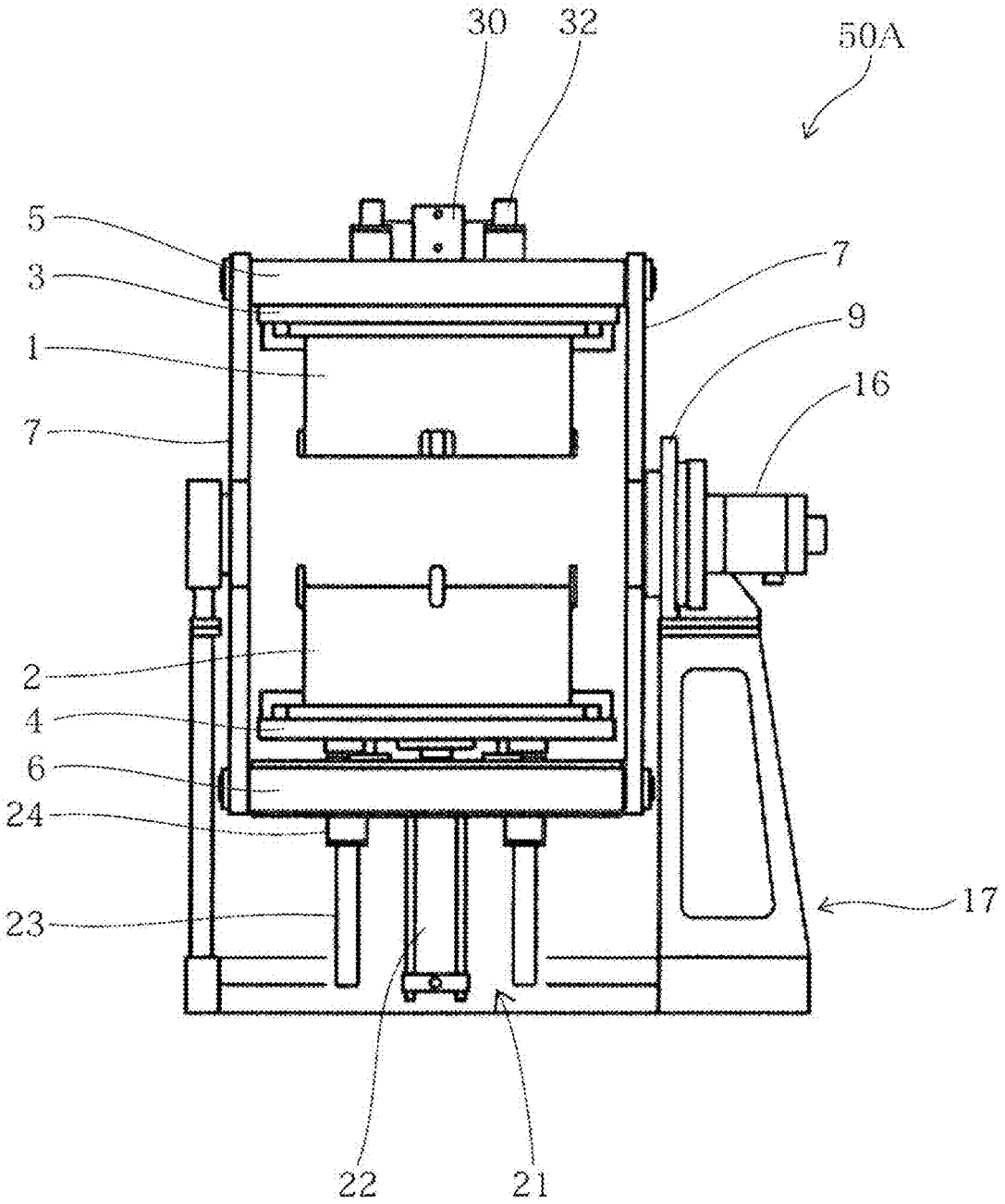
FIG. 18 is a front view of a casting apparatus according to a second embodiment.

FIG. 18 is a front view of a casting apparatus according to a second embodiment. As shown in FIG. 18, a casting apparatus 50A according to the second embodiment is different from the casting apparatus 50 according to the first embodiment mainly in that the opening/closing mechanism 21 moving the lower mold 2 up and down is provided in the lower frame 6. Since the opening/closing mechanism 21 is provided on the lower frame 6, the lower mold 2 in a casting apparatus 50A can move up and down. Hereinafter, differences between the casting apparatus 50A according to the second embodiment and the casting apparatus 50 according to the first embodiment will be described mainly and common description thereof will be omitted.

Figure 19:
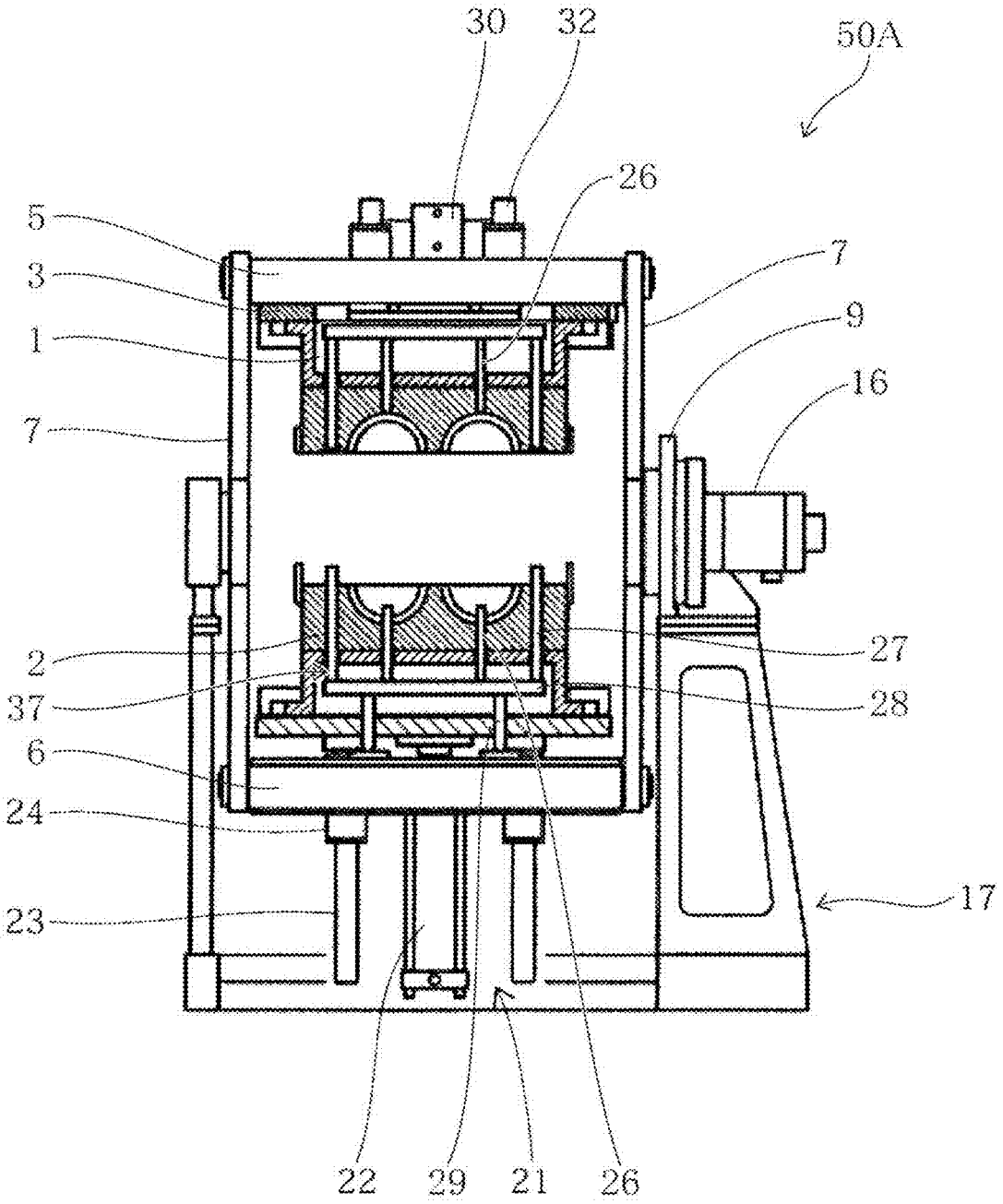
FIG. 19 is a diagram illustrating a cross section of an upper mold and a lower mold in FIG. 18.

FIG. 19 is a diagram illustrating cross sections of the upper die and the lower die in FIG. 18. As shown in FIG. 19, in the casting apparatus 50A, the second hydraulic actuator 30 is provided in the upper frame 5 and the pushing out mechanism 37 is provided in the lower frame 6. In the casting apparatus 50A, the pushing out plate 28 is disposed in an inner space formed in the interior on the bottom end side of the lower mold 2. Each pushing out pin 26 is provided on the top surface of the pushing out plate 28. Each pushing out pin 26 moves up and down through a hole from the inner space of the lower mold 2 to a cavity in which a casting is formed. A distal end of each pushing out pin 26 pushes out the casting in the cavity. Each return pin 27 is provided at a position different from the pushing out pin 26 at the top surface of the pushing out plate 28. Each return pin 27 moves up and down through the hole from the inner space of the lower mold 2 to the top surface of the lower mold 2: In a process in which the upper mold 1 and the lower mold 2 are closed, the distal end of each return pin 27 is abutted against the undersurface of the upper mold 1 to thereby cause the pushing out plate 28 to move down.

Each push rod 29 is provided on the top surface of the lower frame 6. Each push rod 29 is disposed on the top surface of the lower frame 6 by penetrating the lower mold die base 4. Each push rod 29 is inserted into a hole penetrating from the undersurface of the lower mold 2 to the inner space and the distal end of each push rod 29 is disposed below the pushing out plate 28 in the inner space. The length of each push rod 29 is set to a length that the pushing out plate 28 is pushed up when the first hydraulic actuator 22 is contracted and the lower mold 2 becomes a descending end. That is, each push rod 29 passes through the hole penetrating an inner space formed at a lower position of the lower mold 2 from the undersurface of the lower mold 2 and enters the inner space by a predetermined length to prevent the pushing out plate 28 from moving down.

According to the casting method for the casting apparatus 50A, in the step S22, mold removal from the upper mold 1 and mold opening are performed in parallel. More specifically, the casting apparatus 50A causes the lower mold 2 to move down through the opening/closing mechanism 21 provided in the lower frame 6 and starts mold opening of the upper mold 1 and the lower mold 2. Simultaneously with this, the casting apparatus 50A starts extending operation of the second hydraulic actuator 30 provided in the upper frame 5. Extension of the second hydraulic actuator 30 causes the pushing out pin 26 incorporated in the upper mold 1 to be pushed out. In this way, a casting (not shown) made of molten metal coagulating in the upper mold 1 and the lower mold 2 is removed from the upper mold 1 and held to the lower mold 2. In above process S23, mold removal from the lower mold 2 is performed. More specifically, the opening/closing mechanism 21 causes the lower mold 2 to move down to a descending end. Thus, the distal end of the push rod 29 relatively pushes out the pushing out pin 26 with respect to the lower mold 2 via the pushing out plate 28 incorporated in the lower mold 2. As a result, the casting held to the lower mold 2 is removed from the lower mold 2.

As described above, in the casting apparatus 50 or 50A, the pair of sub-link members 8 are each provided with the bearing 42 at the central part thereof. The base frame 17 includes the rotating shaft 41. Since the bearing 42 is placed, the rotating shaft 41 rotatably supports the sub-link members 8 via the bearing 42. Since the retracting mechanism 40 causes the rotating shaft 41 to retract from the placement position, the upper mold 1 and the lower mold 2 can tilt not only in the direction in which the bearing 42 is lifted from the rotating shaft 41 (that is, tilting by left-hand turn) but also in the opposite direction.

The retracting mechanism 40 is provided on the base frame 17. Since the base frame 17 is not rotated by the rotation actuator 16, it is possible to suppress a load on the rotation actuator 16 compared to the case where the retracting mechanism 40 is provided on the part rotated by the rotation actuator 16.

Since the retracting mechanism 40 moves the rotating shaft 41 in the axial direction thereof, the rotating shaft 41 can be easily retracted from the placement position.

The bearing 42 includes the groove part 43 capable of abutting on less than or equal to half of the outer circumferential surface of the rotating shaft 41 in the circumferential direction. For this reason, the bearing 42 is easily placed on the rotating shaft 41 disposed at the placement position. Furthermore, the bearing 42 placed on the rotating shaft 41 is easily lifted from the rotating shaft 41 as the tilt rotating shaft 10 makes a left-hand turn. Therefore, the upper mold 1 and the lower mold 2 can be easily tilted.

The respective embodiments have been described so far, but the present disclosure is not limited to the above respective embodiments. For example, in the casting apparatus 50 or 50A, the retracting mechanism 40 needs only to be able to cause the rotating shaft 41 to retract to the retracting position, and the rotating shaft 41 may be moved in a direction other than the axial direction. The rotating shaft 41 may be provided not only on the drive-side support frame 19 and the driven-side support frame 20 but also on other parts of the base frame 17.

The step S17 may be omitted. That is, after being closed, the upper mold 1 and the lower mold 2 may be brought into a tilted state of left-hand turn instead of a tilted state of right-hand turn. In this case, the bearing 42 is lifted from the rotating shaft 41, and the upper mold 1 and the lower mold 2 are tilted.

Instead of the second hydraulic actuator 30 removing a casting from the upper mold 1 or the lower mold 2, the pushing out plate 28 may be pushed out using a spring. In that case, when the upper mold 1 and lower mold 2 are closed, the upper mold 1 pushes down the return pins 27 of the lower mold 2 to push down the pushing out pins 26. Therefore, although the mold closing force is canceled out by the pushing down force of the return pins 27, it is possible to reduce the number of actuators.

The casting apparatus 50 or 50A may be disposed in plurality. At this time, there is no limit to an arrangement of the casting apparatus 50, 50A as long as the pouring apparatus can pour molten metal. The core may be fitted not only by the operator but also by a core fitting robot provided with articulated arms. The opening/closing mechanism 21 may cause both the upper mold 1 and the lower mold 2 to move up and down.

REFERENCE SIGNS LIST

1 . . . upper mold, 2 . . . lower mold, 5 . . . upper frame, 6 . . . lower frame, 7 . . . main link members, 7*a* . . . first main link member, 7*b* . . . second main link member, 8 . . . sub-link members, 8*a* . . . first sub-link member, 8*b* . . . second sub-link member, 10 . . . tilt rotating shaft (first rotating shaft, third rotating shaft), 16 . . . rotation actuator. (drive unit), 17 . . . base frame, 21 . . . opening/closing mechanism, 40 . . . retracting mechanism, 41 . . . rotating shaft (second rotating shaft, fourth rotating shaft), 42 . . . bearing (first bearing, second bearing), 43 . . . groove part 50, 50A . . . casting apparatus

The invention claimed is:

1. A casting apparatus forming a casting by using openable/closable and tiltable upper and lower molds, with molten metal being poured into the casting apparatus by using gravity, the casting apparatus comprising:

an upper frame mounted with the upper mold;

a lower frame mounted with the lower mold;

an opening/closing mechanism moving either the upper mold or the lower mold up and down to thereby open or close the upper mold and the lower mold;

a first main link member, a top end part thereof being rotatably connected to the upper frame and a bottom end part thereof being rotatably connected to the lower frame, the first main link member including a first rotating shaft at a central part thereof;

a first sub-link member disposed in parallel with the first main link member, a top end part thereof being rotatably connected to the upper frame and a bottom end part thereof being rotatably connected to the lower frame, the first sub-link member including a first bearing at a central part thereof;

a drive unit connected to the first rotating shaft and causing the first main link member to rotate around the first rotating shaft;

a base frame including a second rotating shaft with the first bearing placed thereon to thereby rotatably support the first sub-link member via the first bearing; and a retracting mechanism causing the second rotating shaft to retract from a position at which the first bearing can be placed, wherein the upper frame, the lower frame, the first main link member and the first sub-link member constitute a first parallel link mechanism.

2. The casting apparatus according to claim 1, wherein the retracting mechanism is provided on the base frame.

3. The casting apparatus according to claim 2, wherein the retracting mechanism moves the second rotating shaft in an axial direction thereof.

4. The casting apparatus according to claim 3, wherein the first bearing includes a groove part capable of abutting on less than or equal to half of an outer circumferential surface of the second rotating shaft in a circumferential direction.

5. The casting apparatus according to claim 4, further comprising:

a second main link member, a top end part thereof being rotatably connected to the upper frame and a bottom end part thereof being rotatably connected to the lower frame, the second main link member including a third rotating shaft at a central part thereof; and a second sub-link member disposed in parallel with the second main link member, a top end part thereof being rotatably connected to the upper frame and a bottom end part thereof being rotatably connected to the lower frame, the second sub-link member including a second bearing at a central part thereof, wherein the base frame further includes a fourth rotating shaft with the second bearing placed thereon to thereby rotatably support the second sub-link member via the second bearing, the retracting mechanism causes the fourth rotating shaft to retract from a position at which the second bearing can be placed, and the upper frame, the lower frame, the second main link member and the second sub-link member constitute a second parallel link mechanism.

6. The casting apparatus according to claim 3, further comprising:

a second main link member, a top end part thereof being rotatably connected to the upper frame and a bottom end part thereof being rotatably connected to the lower frame, the second main link member including a third rotating shaft at a central part thereof; and a second sub-link member disposed in parallel with the second main link member, a top end part thereof being rotatably connected to the upper frame and a bottom end part thereof being rotatably connected to the lower frame, the second sub-link member including a second bearing at a central part thereof, wherein the base frame further includes a fourth rotating shaft with the second bearing placed thereon to thereby rotatably support the second sub-link member via the second bearing, the retracting mechanism causes the fourth rotating shaft to retract from a position at which the second bearing can be placed, and the upper frame, the lower frame, the second main link member and the second sub-link member constitute a second parallel link mechanism.

7. The casting apparatus according to claim 2, wherein the first bearing includes a groove part capable of abutting on less than or equal to half of an outer circumferential surface of the second rotating shaft in a circumferential direction.

8. The casting apparatus according to claim 7, further comprising:

a second main link member, a top end part thereof being rotatably connected to the upper frame and a bottom end part thereof being rotatably connected to the lower frame, the second main link member including a third rotating shaft at a central part thereof; and a second sub-link member disposed in parallel with the second main link member, a top end part thereof being rotatably connected to the upper frame and a bottom end part thereof being rotatably connected to the lower frame, the second sub-link member including a second bearing at a central part thereof, wherein the base frame further includes a fourth rotating shaft with the second bearing placed thereon to thereby rotatably support the second sub-link member via the second bearing, the retracting mechanism causes the fourth rotating shaft to retract from a position at which the second bearing can be placed, and the upper frame, the lower frame, the second main link member and the second sub-link member constitute a second parallel link mechanism.

9. The casting apparatus according to claim 2, further comprising:

a second main link member, a top end part thereof being rotatably connected to the upper frame and a bottom end part thereof being rotatably connected to the lower frame, the second main link member including a third rotating shaft at a central part thereof; and a second sub-link member disposed in parallel with the second main link member, a top end part thereof being rotatably connected to the upper frame and a bottom end part thereof being rotatably connected to the lower frame, the second sub-link member including a second bearing at a central part thereof, wherein the base frame further includes a fourth rotating shaft with the second bearing placed thereon to thereby rotatably support the second sub-link member via the second bearing, the retracting mechanism causes the fourth rotating shaft to retract from a position at which the second bearing can be placed, and the upper frame, the lower frame, the second main link member and the second sub-link member constitute a second parallel link mechanism.

10. The casting apparatus according to claim 1, wherein the retracting mechanism moves the second rotating shaft in an axial direction thereof.

11. The casting apparatus according to claim 10, wherein the first bearing includes a groove part capable of abutting on less than or equal to half of an outer circumferential surface of the second rotating shaft in a circumferential direction.

12. The casting apparatus according to claim 11, further comprising:

a second main link member, a top end part thereof being rotatably connected to the upper frame and a bottom end part thereof being rotatably connected to the lower frame, the second main link member including a third rotating shaft at a central part thereof, and a second sub-link member disposed in parallel with the second main link member, a top end part thereof being rotatably connected to the upper frame and a bottom end part thereof being rotatably connected to the lower frame, the second sub-link member including a second bearing at a central part thereof, wherein the base frame further includes a fourth rotating shaft with the second bearing placed thereon to thereby rotatably support the second sub-link member via the second bearing, the retracting mechanism causes the fourth rotating shaft to retract from a position at which the second bearing can be placed, and the upper frame, the lower frame, the second main link member and the second sub-link member constitute a second parallel link mechanism.

13. The casting apparatus according to claim 10, further comprising:

a second main link member, a top end part thereof being rotatably connected to the upper frame and a bottom end part thereof being rotatably connected to the lower frame, the second main link member including a third rotating shaft at a central part thereof; and a second sub-link member disposed in parallel with the second main link member, a top end part thereof being rotatably connected to the upper frame and a bottom end part thereof being rotatably connected to the lower frame, the second sub-link member including a second bearing at a central part thereof, wherein the base frame further includes a fourth rotating shaft with the second bearing placed thereon to thereby rotatably support the second sub-link member via the second bearing, the retracting mechanism causes the fourth rotating shaft to retract from a position at which the second bearing can be placed, and the upper frame, the lower frame, the second main link member and the second sub-link member constitute a second parallel link mechanism.

14. The casting apparatus according to claim 1, wherein the first bearing includes a groove part capable of abutting on less than or equal to half of an outer circumferential surface of the second rotating shaft in a circumferential direction.

15. The casting apparatus according to claim 14, further comprising:

a second main link member, a top end part thereof being rotatably connected to the upper frame and a bottom end part thereof being rotatably connected to the lower frame, the second main link member including a third rotating shaft at a central part thereof; and a second sub-link member disposed in parallel with the second main link member, a top end part thereof being rotatably connected to the upper frame and a bottom end part thereof being rotatably connected to the lower frame, the second sub-link member including a second bearing at a central part thereof, wherein the base frame further includes a fourth rotating shaft with the second bearing placed thereon to thereby rotatably support the second sub-link member via the second bearing, the retracting mechanism causes the fourth rotating shaft to retract from a position at which the second bearing can be placed, and the upper frame, the lower frame, the second main link member and the second sub-link member constitute a second parallel link mechanism.

16. The casting apparatus according to claim 1, further comprising:

a second main link member, a top end part thereof being rotatably connected to the upper frame and a bottom end part thereof being rotatably connected to the lower frame, the second main link member including a third rotating shaft at a central part thereof; and a second sub-link member disposed in parallel with the second main link member, a top end part thereof being rotatably connected to the upper frame and a bottom end part thereof being rotatably connected to the lower frame, the second sub-link member including a second bearing at a central part thereof, wherein the base frame further includes a fourth rotating shaft with the second bearing placed thereon to thereby rotatably support the second sub-link member via the second bearing, the retracting mechanism causes the fourth rotating shaft to retract from a position at which the second bearing can be placed, and the upper frame, the lower frame, the second main link member and the second sub-link member constitute a second parallel link mechanism.

* * * * *